US009924843B2

(12) United States Patent
Song

(10) Patent No.: US 9,924,843 B2
(45) Date of Patent: Mar. 27, 2018

(54) GROUND BRUSH FOR VACUUM CLEANER AND VACUUM CLEANER WITH THE SAME

(71) Applicant: JIANGSU MIDEA CLEANING APPLIANCES CO., LTD., Suzhou (CN)

(72) Inventor: Bingxian Song, Suzhou (CN)

(73) Assignee: JIANGSU MIDEA CLEANING APPLIANCES CO., LTD., Suzhou (CN)

( * ) Notice: Subject to any disclaimer, the term of this patent is extended or adjusted under 35 U.S.C. 154(b) by 0 days.

(21) Appl. No.: 15/235,507

(22) Filed: Aug. 12, 2016

(65) Prior Publication Data

US 2017/0188765 A1 Jul. 6, 2017

(30) Foreign Application Priority Data

| | | |
|---|---|---|
| Jan. 4, 2016 | (CN) | 2016 1 0003338 |
| Jan. 4, 2016 | (CN) | 2016 1 0003386 |
| Jan. 4, 2016 | (CN) | 2016 1 0003925 |
| Jan. 4, 2016 | (CN) | 2016 2 0005689 U |
| Jan. 4, 2016 | (CN) | 2016 2 0005697 U |
| Jan. 4, 2016 | (CN) | 2016 2 0005750 U |
| Jan. 4, 2016 | (CN) | 2016 2 0005828 U |
| Jan. 4, 2016 | (CN) | 2016 2 0005909 U |
| Jan. 4, 2016 | (CN) | 2016 2 0007221 U |

(51) Int. Cl.

| | |
|---|---|
| ***A47L 9/04*** | (2006.01) |
| ***A47L 9/06*** | (2006.01) |
| ***A47L 9/28*** | (2006.01) |

(52) U.S. Cl.
CPC ..... *A47L 9/0477* (2013.01); *A47L 9/0673* (2013.01); *A47L 9/2857* (2013.01)

(58) Field of Classification Search
CPC ..... A47L 9/0477; A47L 9/2857; A47L 9/066; A47L 9/0673; A47L 9/04
USPC ..... 15/415.1
See application file for complete search history.

(56) References Cited

U.S. PATENT DOCUMENTS

| | | | | |
|---|---|---|---|---|
| 9,015,902 | B2 * | 4/2015 | Genn | A47L 9/02 15/415.1 |
| 9,655,486 | B2 * | 5/2017 | Xu | A47L 9/04 |
| 2008/0209671 | A1 * | 9/2008 | Conrad | A47L 9/04 15/389 |

* cited by examiner

*Primary Examiner* — David Redding
(74) *Attorney, Agent, or Firm* — Hodgson Russ LLP

(57) ABSTRACT

A ground brush (1) for a vacuum cleaner includes a ground brush body (10), a brushroll cover (20), and a brushroll assembly (30). The ground brush body (10) is provided with a first mounting groove (101), in which the first mounting groove (101) has an upper opening and a lower opening in communication with each other. The brushroll cover (20) covers on the ground brush body (10), has a first end rotatably connected with the ground brush body (10) and a second end snapped into the ground brush body (10), and has a second mounting groove (201), in which the first mounting groove (101) and the second mounting groove (201) cooperate to form a mounting space. The brushroll assembly (30) includes a brushroll (3) and a driving assembly (302), in which the brushroll is mounted in the mounting space.

21 Claims, 14 Drawing Sheets

GROUND BRUSH FOR VACUUM CLEANER AND VACUUM CLEANER WITH THE SAME

CROSS-REFERENCE TO RELATED APPLICATION

This application claims priority to and benefits of Chinese Patent Application Serial No. 2016100039250.0, Chinese Patent Application Serial No. 2016200058280.0, Chinese Patent Application Serial No. 2016100033860.0, Chinese Patent Application Serial No. 2016200072216.0, Chinese Patent Application Serial No. 2016100033381.0, Chinese Patent Application Serial No. 2016200056891.0, Chinese Patent Application Serial No. 2016200057502.0, Chinese Patent Application Serial No. 2016200059090.0, and Chinese Patent Application Serial No. 2016200056976.0, filed with the State Intellectual Property Office of P. R. China on Jan. 4, 2016, the entire content of which is incorporated herein by reference.

FIELD

The present disclosure relates to a technical field of a vacuum cleaner, and more particularly to a ground brush for a vacuum cleaner and a vacuum cleaner with the same.

BACKGROUND

In the related art, an end of a brushroll cover of a vacuum cleaner is rotatably connected with a ground brush body through a rotating shaft, but the brushroll cover easily falls down when the brushroll cover is rotated to be opened.

Further, because the brushroll is mounted in the brushroll cover, the brushroll has a first end connected with a first end of the brushroll cover to rotate along with the brushroll cover relative to the ground brush body, but there is no reliable connecting structure between a second end of the brushroll cover and a second end of the brushroll, the second end of the brushroll easily falls out of the second end of the brushroll cover when the brushroll rotates along with the brushroll cover.

Furthermore, the brushroll is still working when the brushroll cover is opened, which may injure a user accidentally.

SUMMARY

The present disclosure seeks to solve at least one of the problems existing in the related art to at least some extent. An objective of the present disclosure is to provide a ground brush for a vacuum cleaner, in which the brushroll hardly falls down when the brushroll cover is rotated to be opened, thus effectively preventing the brushroll from falling out of the brushroll cover.

Another objective of the present disclosure is to provide a vacuum cleaner with the above ground brush.

The ground brush according to the first aspect of the present disclosure includes: a ground brush body provided with a first mounting groove, in which the first mounting groove has an upper opening and a lower opening in communication with each other; a brushroll cover covering on the ground brush body, having a first end rotatingly connected with the ground brush body and a second end snapped into the ground brush body, and having a second mounting groove, in which the first mounting groove and the second mounting groove cooperate to form a mounting space; and a brushroll assembly comprising a brushroll and a driving assembly, in which the brushroll is mounted in the mounting space.

According to the ground brush of the present disclosure, when the brushroll needs to be cleaned or replaced, first the second end of the brushroll cover needs to be separated from a snap connection with the ground brush body, then the brushroll cover is rotated to be opened, the brushroll can be taken out from the mounting space, i.e. the brushroll can be cleaned or replaced conveniently, which involves simple operations and is easy to use with less time and less effort. In such a way, a problem that the brushroll in the related art may be replaced only by turning over the ground brush, thereby resulting in tedious operation and inconvenient usage, can be solved to improve user experience.

According to an embodiment of the present disclosure, the first end of the brushroll cover is rotatably connected with the ground brush body through a rotating shaft, the rotating shaft is provided with a torsional spring, and the torsional spring is configured to make the second end of the brushroll cover normally rotate towards a direction away from the ground brush body.

According to an embodiment of the present disclosure, the second end of the brushroll cover has an outer side wall provided with at least one snap groove, the ground brush body is provided with at least one snap cooperating with the at least one snap groove, and the at least one snap has a first end protruding a side wall of the first mounting groove and snapped into the at least one snap groove; the ground brush body has an upper end face provided with a mounting hole, in which a release key is mounted, the mounting hole has a first side wall provided with a communicating hole running through the side wall of the first mounting groove, the at least one snap has a second end connected with a lower end of the release key, and the release key can be pushed to drive the at least one snap to move in the communicating hole to approach or leave the side wall of the first mounting groove; and a first elastic member is supported between a second side wall of the mounting hole opposite the communicating hole and the release key, and the first elastic member can push the release key to approach the side wall of the first mounting groove, such that the first end of the snap protrudes out of the side wall of the first mounting groove.

According to an embodiment of the present disclosure, the brushroll is disposed to the brushroll cover or the ground brush body.

According to an embodiment of the present disclosure, the ground brush body is provided with a first locking member, the first end of the brushroll cover is rotatably connected with the ground brush body through a rotating shaft, the rotating shaft is provide with a second locking member, and when the brushroll cover is rotated to be opened at a certain angle, the first locking member cooperates with the second locking member to lock the brushroll cover to the ground brush body.

According to an embodiment of the present disclosure, one of the first locking member and the second locking member is configured as an elastic protruding structure, and the other one thereof is configured as a first locking groove, when the rotating shaft is rotated to a position where the first locking groove corresponds to the elastic protruding structure, the elastic protruding structure is inserted into the first locking groove to lock the brushroll cover to the ground brush body.

According to an embodiment of the present disclosure, the elastic protruding structure includes an elastic locking member and a locking snapping member, the elastic locking member has a lower end connected to the ground brush body and an upper end connected with the locking snapping member, such that the elastic locking member can drive the locking snapping member to reciprocate, and the locking snapping member has an upper end face provided with a first protrusion; and the first locking groove is formed in the rotating shaft and fitted with the first protrusion, when the rotating shaft is rotated to a position where the first locking groove corresponds to the first protrusion, the first protrusion is inserted into the first locking groove to lock the brushroll cover to the ground brush body.

According to an embodiment of the present disclosure, the locking snapping member is provided with a third mounting groove with an open lower end, and the upper end of the elastic locking member is located in the third mounting groove; the ground brush body is provided with a fourth mounting groove a bottom wall of the fourth mounting groove is provided with a mounting column for the first protrusion, and the lower end of the elastic locking member is fitted over the mounting column.

According to an embodiment of the present disclosure, the rotating shaft is provided with a clearance groove, and before the brushroll cover is opened at the certain angle, an upper end face of the first protrusion abuts against a bottom wall of the clearance groove.

According to an embodiment of the present disclosure, the first locking member is configured as a resilient sheet connected to the ground brush body, and the resilient sheet has an upper end face provided with a second protrusion; and the second locking member is configured as a second locking groove provided in the rotating shaft and fitted with the second protrusion, and when the rotating shaft is rotated to a position where the second locking groove corresponds to the second protrusion, the second protrusion is inserted into the second locking groove to lock the brushroll cover to the ground brush body.

According to an embodiment of the present disclosure, a lower end of the brushroll cover is connected with the ground brush body through a rotating shaft, an upper end of the brushroll cover is provided with a snapping cooperating part, and an upper end of the brushroll is provided with a snapping part, in which the snapping part is configured to cooperate with the snapping cooperating part, such that the brushroll cover can drive the brushroll to rotate relative to the ground brush body.

According to an embodiment of the present disclosure, the snapping part is configured as an elastic protrusion provided on an outer wall face of the brushroll, and the snapping cooperating part is configured as a second snap groove provided in an inner wall face of the brushroll cover; or the snapping part is configured as a third snap groove provided in the outer wall face of the brushroll, and the snapping cooperating part is configured as an elastic protrusion provided on the inner wall face of the brushroll cover.

According to an embodiment of the present disclosure, the snapping part includes a second elastic member and a snapping member, the second elastic member has a lower end connected with the outer wall face of the brushroll and an upper end connected with the snapping member, such that the second elastic member can drive the snapping member to reciprocate, and an upper end face of the snapping member is provided with a third protrusion; and the snapping cooperating part is configures as a fourth snap groove provided in an inner wall face of the brushroll cover and fitted with the third protrusion.

According to an embodiment of the present disclosure, the fourth snap groove is configured as a through groove, the brushroll cover further includes a key which can be inserted into the through groove from top down, and when the key is inserted in the through groove, the third protrusion separates from the through groove.

According to an embodiment of the present disclosure, the snapping cooperating part includes a second elastic member and a snapping member, the second elastic member has an upper end connected to an inner wall face of the brushroll cover and a lower end connected to the snapping member, such that the second elastic member can drive the snapping member to reciprocate, a lower end face of the snapping member is provided with a fourth protrusion, and the snapping part is a fifth snap groove provided in an outer wall face of the brushroll and fitted with the fourth protrusion.

According to an embodiment of the present disclosure, the brushroll cover is provided with a triggering part, and the ground brush body is provided with a microswitch; and the triggering part triggers the microswitch to turn on a control circuit connected with the brushroll when the brushroll cover is closed on the ground brush body, and the triggering part releases a trigger action on the microswitch to turn off the control circuit when the brushroll cover is opened.

According to an embodiment of the present disclosure, the brushroll cover includes a cover body cooperating with the ground brush body to form a mounting space; and a connecting part connected between the cover body and the ground brush body to make the cover body connected to the ground brush body, in which the triggering part is disposed on any one of the cover body and the connecting part.

According to an embodiment of the present disclosure, the connecting part includes a rotating shaft, the cover body is rotatingly closed on the ground brush body through the rotating shaft, in which the triggering part is disposed on the rotating shaft, and the rotating shaft rotates to make the triggering part trigger the microswitch when the cover body is rotatingly closed.

According to an embodiment of the present disclosure, the connecting part includes a rotating shaft, the cover body is rotatingly closed on the ground brush body through the rotating shaft, the triggering part is disposed on the brushroll cover, and the triggering part triggers the microswitch when the brushroll cover is closed.

According to an embodiment of the present disclosure, when the brushroll cover is closed on the ground brush body, the triggering part directly contacts and triggers the microswitch.

According to an embodiment of the present disclosure, the microswitch includes: a fixing member fixed to the ground brush body and coupled with the control circuit; a resilient member disposed on the fixing member; and a button disposed on the fixing member and located between the resilient member and the fixing member, in which the triggering part can turn on the control circuit if the resilient member presses the button, and when the triggering part separates from the resilient member, the button returns to turn off the control circuit.

According to an embodiment of the present disclosure, the ground brush further includes a driving member disposed on the ground brush body and cooperating with the microswitch, in which when the brushroll cover is closed on the ground brush body, the triggering part triggers the driving member and then triggers the microswitch indirectly through the driving member.

The vacuum cleaner according to the second aspect of the present disclosure includes the ground brush of the first aspect of the present disclosure.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of the present disclosure will become apparent and more readily appreciated from the following descriptions of embodiments made with reference to the drawings, in which.

REFERENCE NUMERALS

Figure 1:
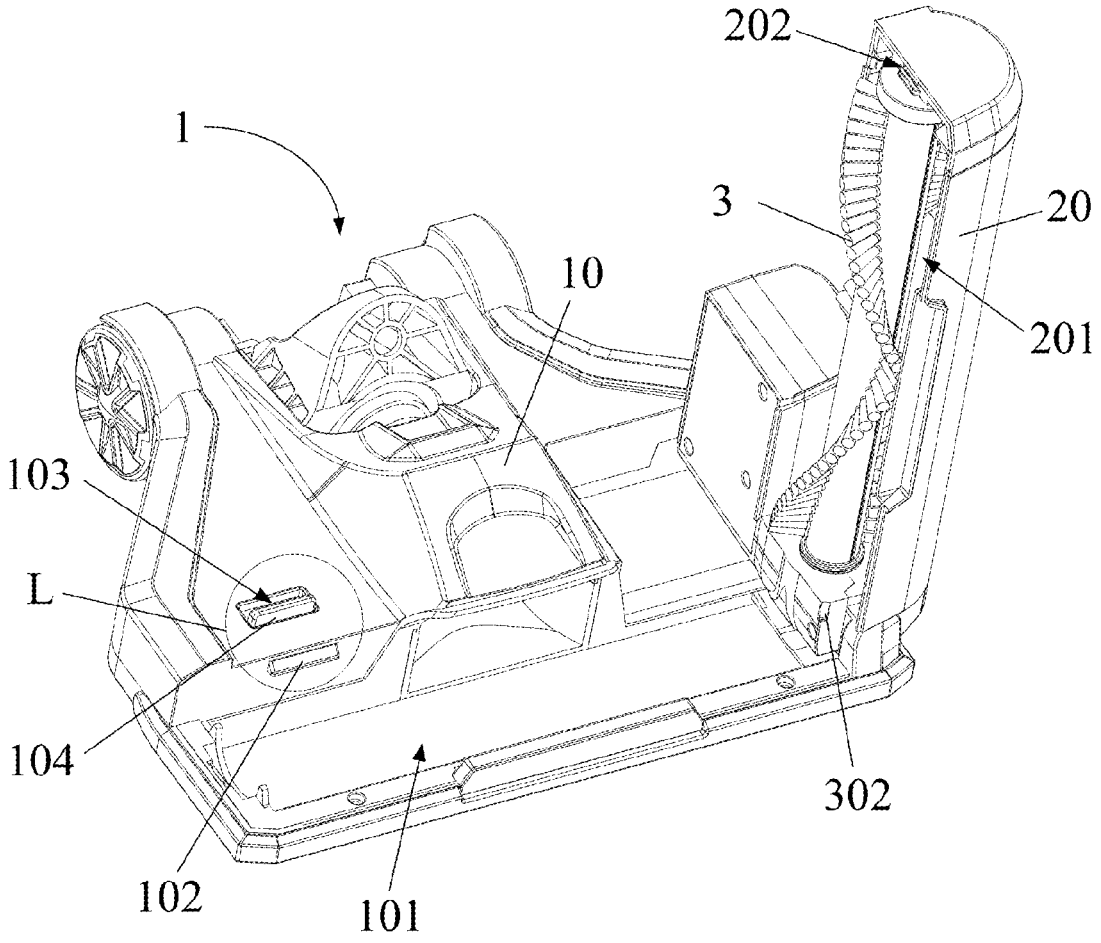
FIG. 1 is a schematic view of a ground brush for a vacuum cleaner according to an embodiment of the present disclosure.

1 ground brush; 10 ground brush body; 101 first mounting groove; 102 snap; 103 mounting hole; 104 release key; 105 communicating hole; 20 brushroll cover; 201 second mounting groove; 202 limiting groove; 303 first snap groove; 21 rotating shaft; 205 first snap groove; 30 brushroll assembly; 302 driving assembly; 11 elastic protruding structure; 111 elastic locking member; 112 locking snapping member; 113 first protrusion; 1121 third mounting groove; 12 fourth mounting groove; 13 mounting column; 211 first locking groove; 212 clearance groove; 3 brushroll; 22 elastic protrusion; 31 brushroll body; 32 end cover; 321 third snap groove; 204 cover body; 203 triggering part; 40 microswitch; 401 fixing member; 402 resilient member; 4021 fixing part; 4022 resilient part; 403 button.

DETAILED DESCRIPTION

Reference will be made in detail to embodiments of the present disclosure. Examples of the embodiments are shown in the drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, it is to be understood that terms such as "central," "upper," "lower," "front," "rear," "left," "right," "vertical," "horizontal," "top," "bottom," "inner," and "outer" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the following, a ground brush 1 for a vacuum cleaner (not shown in the drawings) according to embodiments of a first aspect of the present disclosure will be described with reference to FIG. 1 to FIG. 16.

As shown in FIG. 1, the ground brush 1 for the vacuum cleaner according to the embodiments of the first aspect of the present disclosure includes a ground brush body 10, a brushroll cover 20 and a brushroll assembly 30

Specifically, the ground brush body 10 is provided with a first mounting groove 101, and the first mounting groove 101 has an upper opening and a lower opening in communication with each other. The brushroll cover 20 covers the ground brush body 10, and the brushroll cover 20 has a first end rotatably connected with the ground brush body 10 and a second end snapped in the ground brush body 10. The brushroll cover 20 is provided with a second mounting groove 201, and the first mounting groove 101 and the second mounting groove 201 cooperate with each other to form a mounting space. The brushroll assembly 30 includes a brushroll 3 and a driving assembly 302, and the brushroll 3 is mounted in the mounting space. The driving assembly 302 may be mounted in the mounting space to drive the brushroll 3 to rotate.

For the ground brush 1 according to the embodiment of the present disclosure, the ground brush body 10 is provided with the first mounting groove 101, the first mounting groove 101 has the upper opening and the lower opening in communication with each other, and the brushroll cover 20 is provided with the second mounting groove 201; and the first mounting groove 101 and the second mounting groove 201 form the mounting space when the brushroll cover 20 covers on the ground brush body 10, and the brushroll 3 is mounted in the mounting space. The brushroll 3 can clean a carpet through the lower opening of the first mounting groove 101, thus accomplishing a normal cleaning function of the brushroll 3. As to a specific mounting position of the brushroll assembly 30, the brushroll assembly 30 can be mounted in the first mounting groove 101, that is the brushroll assembly 30 is connected with the ground brush body 10, or the brushroll assembly 30 can be mounted in the second mounting groove 201, that is the brushroll assembly 30 is connected with the brushroll cover 20. When the brushroll 3 needs to be cleaned or replaced, first the second end of the brushroll cover 20 needs to be separated from a snap connection with the ground brush body 10, then the brushroll cover 20 is rotated to be opened, and thus the brushroll 3 can be taken out from the first mounting groove 101 or the second mounting groove 201, that is the brushroll 3 can be taken out from the brushroll cover 20, i.e. the brushroll 3 can be cleaned or replaced conveniently, which involves simple operations and is easy to use with less time and less effort. In such a way, a problem that the brushroll 3 in the related art may be replaced only by turning over the ground brush, thereby resulting in tedious operation and inconvenient usage, can be solved to improve user experience.

In some embodiments of the present disclosure, the first end of the brushroll cover is rotatably connected with the ground brush body through a rotating shaft, the rotating shaft is provided with a torsional spring, and the torsional spring is configured to make the second end of the brushroll cover normally rotate towards a direction away from the ground brush body. Optionally, the brushroll is disposed to the brushroll cover or the ground brush body.

Figure 2:
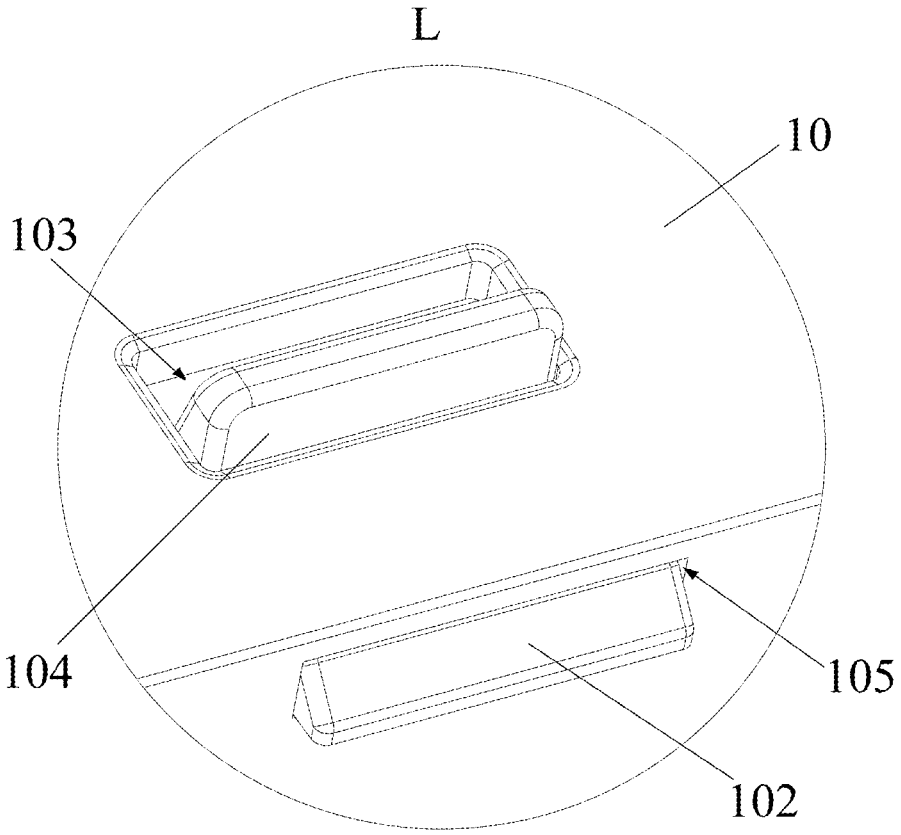
FIG. 2 is an enlarged view of part L circled in FIG. 1.

Specifically, as shown in FIG. 1 and FIG. 2, both the driving assembly 302 and the brushroll 3 are mounted in the second mounting groove 201, and fixedly connected with the first end of the brushroll cover 20. The first end of the brushroll 3 is connected with the driving assembly 302, and the second end of the brushroll 3 is rotatably connected with the second end of the brushroll cover 20.

Therefore, the ground brush body is provided with the first mounting groove 101, the first mounting groove 101 has the upper opening and the lower opening in communication with each other, and the brushroll 3 and the driving assembly 302 are mounted in the second mounting groove of the brushroll cover 20. When the brushroll cover 20 covers on the ground brush body 10, the driving assembly 302 drives the brushroll 3 to rotate, the brushroll 3 can clean a carpet through the lower opening of the first mounting groove 101, thus accomplishing a normal cleaning function of the brushroll 3. When the brushroll 3 needs to be cleaned or replaced, first the second end of the brushroll cover 20 needs to be separated from a snap connection with the ground brush body 10, then the first end of the brushroll cover 20 is rotated to be opened, and thus the brushroll 3 can be taken out from the second mounting groove 201, that is the brushroll 3 can be taken out from the brushroll cover 20, i.e. the brushroll 3 can be cleaned or replaced conveniently, which involves simple operations and is easy to use with less time and less effort. In such a way, a problem that the brushroll 3 in the related art may be replaced only by turning over the ground brush 1, thereby resulting in tedious operation and inconvenient usage, can be solved to improve user experience.

In an embodiment of the present disclosure, as shown in FIG. 1, the first end of the brushroll cover 20 is rotatably connected with a left end or a right end of the ground brush body 10, such that the brushroll cover 20 can be rotated leftwards or rightwards relative to the ground brush body 10 to be opened. Optionally, as shown in FIG. 1, the first end of the brushroll cover 20 is rotatably connected with the ground brush body 10 through a rotating shaft (not shown in the figure). Further, the rotating shaft is provided with a torsional spring, such that the brushroll cover 20 can move upwards to be opened under a torsion action of the torsional spring.

In the above embodiment, the first end of the brushroll cover 20 is rotatably connected with the ground brush body 10 through the rotating shaft, the rotating shaft is provided with the torsional spring, and the torsional spring has a first end abutting against the brushroll cover 20 and a second end abutting against the ground brush body 10. When the brushroll cover 20 needs to be opened, only the second end of the brushroll cover 20 needs to be separated from the snap connection with the ground brush body 10, the brushroll cover 20 can automatically move upwards to be opened under the torsion action of the torsional spring, which improves a degree of automation and makes an operation more convenient when the brushroll cover is opened.

In an embodiment of the present disclosure, as shown in FIG. 1, an outer side wall of the second end of the brushroll cover 20 is provided with a first snap groove (not shown in the figure), the ground brush body 10 is provide with a snap 102 cooperating with the first snap groove, and the snap 102 has a first end protruding a side wall of the first mounting groove 101 and snapped into the first snap groove.

Further, as shown in FIG. 1 and FIG. 2, the ground brush body 10 has an upper end face provided with a mounting hole 103, in which a release key 104 is mounted; the mounting hole 103 has a first side wall provided with a communicating hole 105 running through the side wall of the first mounting groove 101, the snap 102 has a second end connected with a lower end of the release key 104, and the release key 104 can be pushed to drive the snap 102 to move in the communicating hole 105 to approach or leave the side wall of the first mounting groove 101.

Furthermore, a first elastic member (not shown in the figures) is supported between a second side wall of the mounting hole 103 opposite the communicating hole 105 and the release key 104, and the first elastic member can push the release key 104 to approach the side wall of the first mounting groove 101, such that the first end of the snap 102 protrudes out of the side wall of the first mounting groove 101.

In the above embodiment, a fixation provided between the second end of the brushroll cover 20 and the ground brush body 10 is configured to be the snap connection by means of the snap 102 and the first snap groove, so the fixation between the brushroll cover 20 and the ground brush body 10 is firm and reliable. The release key 104 is fitted with the first elastic member, such that when the brushroll cover 20 needs to be closed, the brushroll cover 20 can push the first end of the snap 102 to retract into the communicating hole 105 and press the first elastic member, and then the first elastic member stores elastic potential energy; after the brushroll cover 20 is closed in place, the first snap groove is just located at a position corresponding to the snap 102, and at the same time, the first elastic member releases the elastic potential energy to push the first end of the snap 102 to protrude out of the side wall of the first mounting groove 101 and to be snapped into the first snap groove, so as to realize the firm fixation between the brushroll cover 20 and the ground brush body 10; and when the brushroll cover 20 needs to be opened, the release key 104 is pushed by hands to drive the snap 102 to leave the side wall of the first mounting groove 101, such that the first end of the snap 102 retracts into the communicating hole 105, at the same time, the snap 102 is separated from the snap connection with the first snap groove, and a force applied to the ground brush body 10 by the second end of the brushroll cover is removed, in which case the brushroll cover 20 can be rotated manually to be opened; or the brushroll cover 20 may rotate automatically to an open state under the torsion action of the torsional spring, at the same time, the first end of the snap 102 protrudes out from the side wall of the first mounting groove 101 again under an elastic action of the first elastic member, and the brushroll cover 20 can be opened and closed by such cycle, which is simple in structure, convenient in operation, easy and practicable.

The release key 104 and the snap 102 may be configured as two members connected together, so as to facilitate the assembling of the release key 104 and the snap 102. Certainly, the release key 104 and the snap 102 may be integrally formed and mounted to the ground brush body 10 in the process of assembling the ground brush body 10.

Preferably, as shown in FIG. 2, the first end of the snap 102 protruding out of the side wall of the first mounting groove 101 has a triangular longitudinal section and an upper end face configured as a guiding slope, and gradually inclining from the top down towards an inner side of the first mounting groove 101, such that the brush cover 20 can be smoothly closed on the ground brush body 10 along the guiding slope. The first end of the snap 102 has a lower end face configured as a plane parallel to the ground, such that the snap 102 can be prevented from falling out of the first snap groove when the first end of the snap 102 is snapped into the first snap groove in the brushroll cover 20, thus ensuring firmness when the brushroll cover 20 is closed on the ground brush body 10.

In another embodiment of the present disclosure, the outer side wall of the second end of the brushroll cover 20 is provided with the snap 102, the ground brush body 10 is provided with a snap groove cooperating with the snap 102, and the snap 102 can be snapped into the snap groove.

In the above embodiment of the present disclosure, the brushroll cover 20 is provided with the snap 102, the ground brush body 10 is provided with the snap groove correspondingly, and hence the second end of the brushroll cover 20 also can be fixedly or detachably connected with the ground brush body 10 through cooperation of the snap 102 and the snap groove, such that the brushroll cover 20 can be conveniently opened or closed, which will not be described in detail.

In an embodiment of the present disclosure, as shown in FIG. 1, the second end of the brushroll cover 20 is provided with a limiting groove 202, and the second end of the brushroll 3 is disposed in the limiting groove 202.

In the above embodiment, the second end of the brushroll cover 20 is provided with the limiting groove 202, so the first end of the brushroll 3 is connected with the driving assembly 302, and the second end of the brushroll 3 is mounted in the limiting groove 202, which can ensure that the brushroll 3 can normally rotate and can be prevented from falling down, thus raising reliability of a product during usage. Further, the limiting groove 202 may be provided with a receiving groove specially for receiving the driving assembly 302, so the first end of the brushroll 3 is inserted in the receiving groove to be connected with the driving assembly 302, and the second end of the brushroll 3 is mounted in the limiting groove 202. A wall of the receiving groove can support the brushroll 3 to further improve the reliability of the product during usage.

To sum up, according to the ground brush for the vacuum cleaner, the ground brush body is provided with the first mounting groove, and the first mounting groove has the upper opening and the lower opening in communication with each other. The brushroll is rotatably mounted in the second mounting groove, and the brushroll can clean the carpet through the lower opening of the first mounting groove, thus accomplishing the normal cleaning function of the brushroll. When the brushroll needs to be cleaned or replaced, first the second end of the brushroll cover needs to be separated from the snap connection with the ground brush body, then the brushroll cover is rotated to be opened, and thereby the brushroll can be taken out from the upper opening of the first mounting groove, i.e. the brushroll can be cleaned or replaced conveniently, which involves simple operations and is easy to use with less time and less effort. In such a way, the problem that the brushroll in the related art may be replaced only by turning over the ground brush, thereby resulting in tedious operation and inconvenient usage, can be solved to improve user experience.

Figure 3:
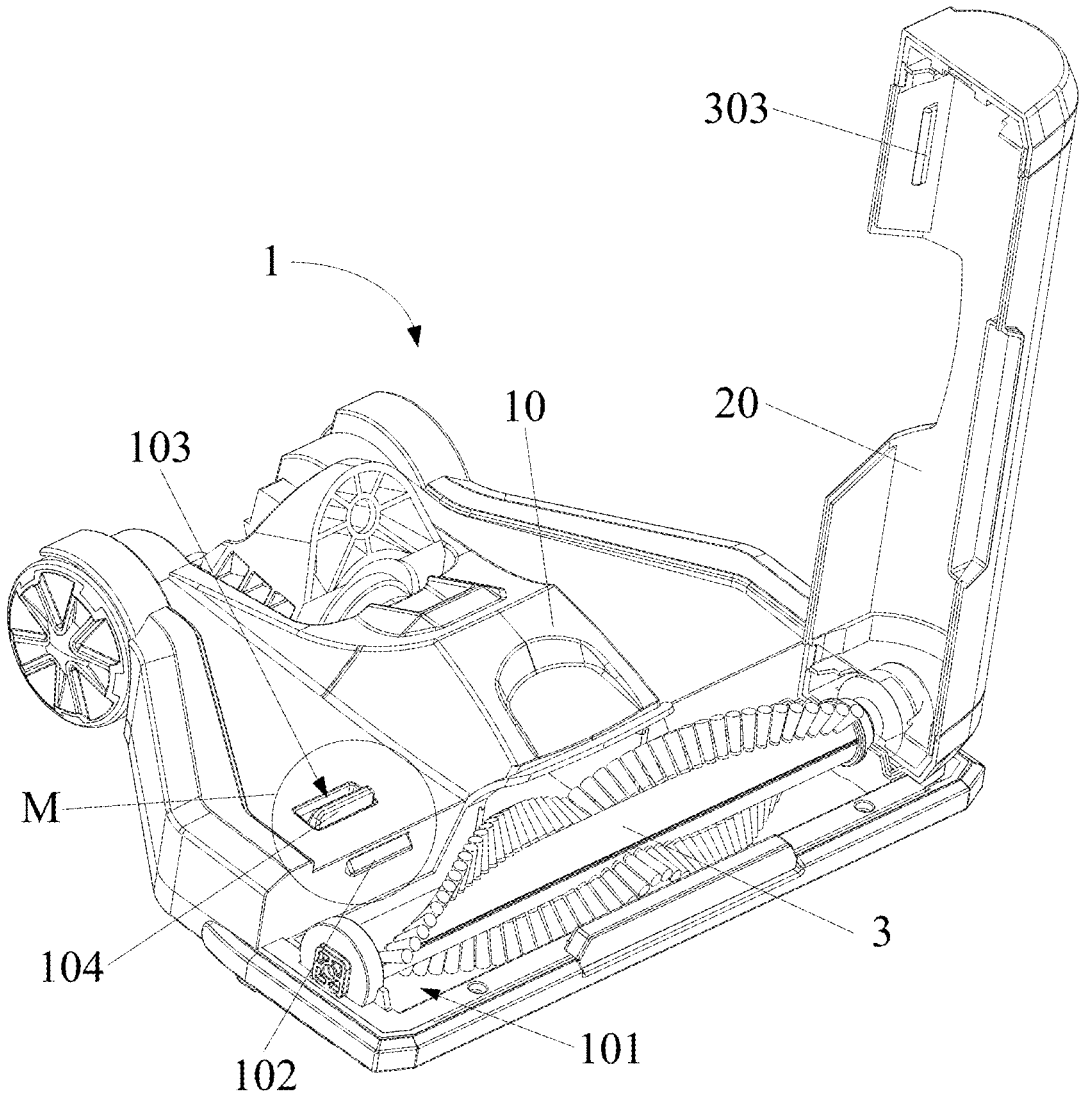
FIG. 3 is a schematic view of a ground brush for a vacuum cleaner according to another embodiment of the present disclosure.
Figure 4:
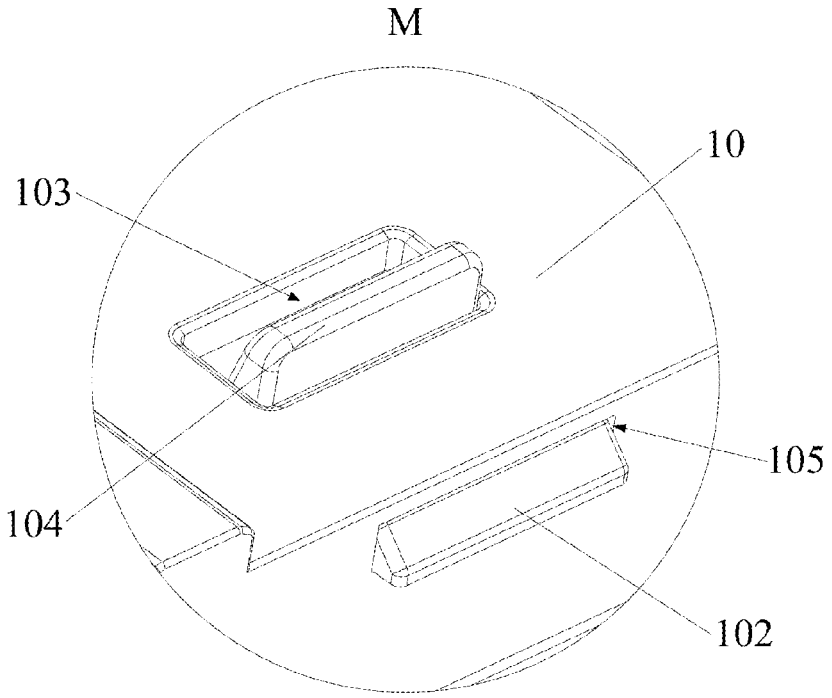
FIG. 4 is an enlarged view of part M circled in FIG. 3.

As shown in FIG. 3 and FIG. 4, the brushroll 3 is rotatably mounted in the first mounting groove 101. Therefore, according to the ground brush provided by the present disclosure, the ground brush body 10 is provided with the first mounting groove 101, the first mounting groove 101 has the upper opening and the lower opening in communication with each other, and the brushroll cover 20 is rotatingly mounted in the first mounting groove. The brushroll 3 can clean the carpet through the lower opening of the first mounting groove 101, thus accomplishing the normal cleaning function of the brushroll 3. When the brushroll 3 needs to be cleaned or replaced, first the second end of the brushroll cover 20 needs to be separated from the snap connection with the ground brush body 10, then the brushroll cover 20 is rotated to be opened, and thus the brushroll 3 can be taken out from the upper opening of the first mounting groove, i.e. the brushroll 3 can be cleaned or replaced conveniently, which involves simple operations and is easy to use with less time and less effort. In such a way, the problem that the brushroll 3 in the related art may be replaced only by turning over the ground brush 1, thereby resulting in tedious operation and inconvenient usage, can be solved to improve user experience.

In an embodiment of the present disclosure, as shown in FIG. 3, two ends of brushroll cover are supported on end walls of the first mounting groove 101, the first end of the brushroll cover 20 is rotatably connected with the ground brush body 10 located at the first end of the brushroll 3, such that the brushroll cover 20 can be rotated in a length direction of the brushroll 3 relative to the ground brush body 10 to be opened. Preferably, as shown in FIG. 3, the first end of the brushroll cover 20 is rotatably connected with the ground brush body 10 through the rotating shaft (not shown in the figure). Further, the rotating shaft is provided with the torsional spring, such that the brushroll cover 20 can move upwards to be opened under the torsion action of the torsional spring.

In the above embodiment, the first end of the brushroll cover 20 is rotatably connected with the ground brush body 10 through the rotating shaft, the rotating shaft is provided with the torsional spring, and the torsional spring has the first end abutting against the brushroll cover 20 and the second end abutting against the ground brush body 10. When the brushroll cover 20 needs to be opened, only the second end of the brushroll cover 20 needs to be separated from the snap connection with the ground brush body 10, the brushroll cover 20 can automatically move upwards to be opened under the torsion action of the torsional spring, which improves the degree of automation and makes the operation more convenient when the brushroll cover is opened.

In an embodiment of the present disclosure, as shown in FIG. 3, the outer side wall of the second end of the brushroll cover 20 is provided with a first snap groove 303, the ground brush body 10 is provide with the snap 102 cooperating with the first snap groove 303, and the snap 102 has the first end protruding the side wall of the first mounting groove 101 and snapped into the first snap groove 303.

Further, as shown in FIG. 3 and FIG. 4, the upper end face of the ground brush body 10 is provided with the mounting hole 103, in which the release key 104 is mounted; the first side wall of the mounting hole 103 is provided with the communicating hole 105 running through the side wall of the first mounting groove 101, the second end of the snap 102 is connected with the lower end of the release key 104, and the release key 104 can be pushed to drive the snap 102 to move in the communicating hole 105 to approach or leave the side wall of the first mounting groove 101.

Furthermore, the first elastic member (not shown in the figures) is supported between the second side wall of the mounting hole 103 opposite the communicating hole 105 and the release key 104, and the first elastic member can push the release key 104 to approach the side wall of the first mounting groove 101, such that the first end of the snap 102 protrudes out of the side wall of the first mounting groove 101.

In the above embodiment, a fixation provided between the second end of the brushroll cover 20 and the ground brush body 10 is configured to be the snap connection by means of the snap 102 and the first snap groove 303, so the fixation between the brushroll cover 20 and the ground brush body 10 is firm and reliable. The release key 104 is fitted with the first elastic member, such that when the brushroll cover 20 needs to be closed, the brushroll cover 20 can push the first end of the snap 102 to retract into the communicating hole 105 and press the first elastic member, and then the first elastic member stores the elastic potential energy; after the brushroll cover 20 is closed in place, the first snap groove 303 is just located at a position corresponding to the snap 102, and at the same time, the first elastic member releases the elastic potential energy to push the first end of the snap 102 to protrude out of the side wall of the first mounting groove 101 and to be snapped into the first snap groove 303, so as to realize the firm fixation between the brushroll cover 20 and the ground brush body 10; and when the brushroll cover 20 needs to be opened, the release key 104 is pushed by hands to drive the snap 102 to leave the side wall of the first mounting groove 101, such that the first end of the snap 102 retracts into the communicating hole 105, at the same time, the snap 102 is separated from the snap connection with the first snap groove 303, and the force applied to the ground brush body 10 by the second end of the brushroll cover is removed, in which case the brushroll cover 20 can be rotated manually to be opened; or the brushroll cover 20 may rotate automatically to the open state under the torsion action of the torsional spring, at the same time, the first end of the snap 102 protrudes out from the side wall of the first mounting groove 101 again under the elastic action of the first elastic member, and the brushroll cover 20 can be opened and closed by such cycle, which is simple in structure, convenient in operation, easy and practicable.

Preferably, as shown in FIG. 4, the first end of the snap 102 protruding out of the side wall of the first mounting groove 101 has the triangular longitudinal section and the upper end face configured as the guiding slope gradually inclining from the top down towards an inner side of the first mounting groove 101, such that the brushroll cover 30 can be smoothly closed on the ground brush body 10 along the guiding slope. The first end of the snap 102 has the lower end face configured as the plane parallel to the ground, such that the snap 102 can be prevented from falling out of the first snap groove 303 when the first end of the snap 102 is snapped into the first snap groove 303 in the brushroll cover 20, thus ensuring firmness when the brushroll cover 20 is closed on the ground brush body 10.

In another embodiment of the present disclosure, the outer side wall of the second end of the brushroll cover 20 is provided with the snap 102, the ground brush body 10 is provided with the snap groove cooperating with the snap 102, and the snap 102 can be snapped into the snap groove.

In the above embodiment of the present disclosure, the brushroll cover 20 is provided with the snap 102, the ground brush body 10 is provided with the snap groove correspondingly, and hence the second end of the brushroll cover 20 also can be fixedly or detachably connected with the ground brush body 10 through cooperation of the snap 102 and the snap groove, such that the brushroll cover 20 can be conveniently opened or closed, which will not be described in detail.

In an embodiment of the present disclosure, as shown in FIG. 1, the ground brush body 10 is provided with the driving assembly connected with the brushroll 3, and the driving assembly can drive the brushroll 3 to rotate relative to the ground brush body 10.

To sum up, according to the ground brush for the vacuum cleaner, the ground brush body is provided with the first mounting groove, and the first mounting groove has the upper opening and the lower opening in communication with each other. The brushroll is rotatably mounted in the first mounting groove, and the brushroll can clean the carpet through the lower opening of the first mounting groove, thus accomplishing the normal cleaning function of the brushroll. When the brushroll needs to be cleaned or replaced, first the second end of the brushroll cover needs to be separated from the snap connection with the ground brush body, then the brushroll cover is rotated to be opened, and thereby the brushroll can be taken out from the upper opening of the first mounting groove, i.e. the brushroll can be cleaned or replaced conveniently, which involves simple operations and is easy to use with less time and less effort. In such a way, the problem that the brushroll in the related art may be replaced only by turning over the ground brush, thereby resulting in tedious operation and inconvenient usage, can be solved to improve user experience.

Figure 5:
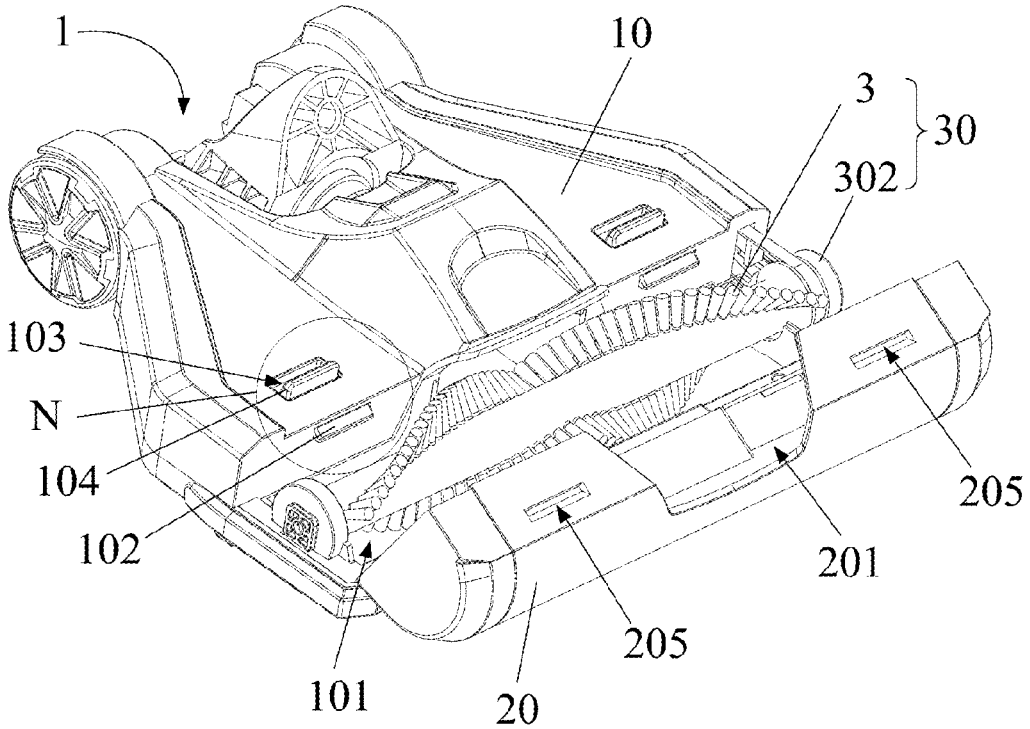
FIG. 5 is a schematic view of a ground brush for a vacuum cleaner according to another embodiment of the present disclosure.

As shown in FIG. 5, the first end of the brushroll cover is rotatably connected with a front end of the ground brush body 10, such that the brushroll cover 20 can be rotated frontwards or backwards relative to the ground brush body 10 to be opened. Optionally, as shown in FIG. 1, the first end of the brushroll cover 20 is rotatably connected with the ground brush body 10 through a rotating shaft. Further, the rotating shaft is provided with the torsional spring, such that the brushroll cover 20 can move upwards to be opened under a torsion action of the torsional spring.

In the above embodiment, the first end of the brushroll cover 20 is rotatably connected with the ground brush body 10 through the rotating shaft, the rotating shaft is provided with the torsional spring, and the torsional spring has the first end abutting against the brushroll cover 20 and the second end abutting against the ground brush body 10. When the brushroll cover 20 needs to be opened, only the second end of the brushroll cover 20 needs to be separated from the snap connection with the ground brush body 10, the brushroll cover 20 can automatically move upwards to be opened under the torsion action of the torsional spring, which improves the degree of automation and makes the operation more convenient when the brushroll cover is opened.

According to an embodiment of the present disclosure, the outer wall of the second end of the brushroll cover 20 is provided with a first snap groove 205, the ground brush body 10 is provided with the snap 102 cooperating with the first snap groove 205, and the first end of the snap 102 protrudes out of the side wall of the first mounting groove 101 and is snapped into the first snap groove 205. Preferably, as shown in FIG. 5, the other end of the brushroll cover 20 is provided with a plurality of the first snap groove 205, the ground brush body 10 is provided with a plurality of the snaps 102, and the plurality of the snaps 102 cooperate with the plurality of the first snap groove 205.

Further, the upper end face of the ground brush body 10 is provided with the mounting hole 103, in which the release key 104 is mounted; the first side wall of the mounting hole 103 is provided with the communicating hole 105 running through the side wall of the first mounting groove 101, the second end of the snap 102 is connected with the lower end of the release key 104, and the release key 104 can be pushed to drive each the snap 102 to move in the communicating hole 105 to approach or leave the side wall of the first mounting groove 101.

Furthermore, the first elastic member is supported between the second side wall of the mounting hole 103 opposite the communicating hole 105 and the release key 104, and the first elastic member can push the release key 104 to approach the side wall of the first mounting groove 101, such that the first end of each the snap 102 protrudes out of the side wall of the first mounting groove 101.

In the above embodiment, a fixation provided between the second end of the brushroll cover 20 and the ground brush body 10 is configured to be the snap connection by means of the snap 102 and a first snap groove 205, so the fixation between the brushroll cover 20 and the ground brush body 10 is firm and reliable. Because the brushroll cover 20 is relatively long, the plurality of the snaps 102 and the plurality of the first snap groove 205 are provided, and preferably, each of a left side and a right side of the brushroll cover is provided with one snap or one first snap groove, such that, the fixation between the brushroll cover 20 and the ground brush body 10 can be firmer and more reliable. The release key 104 is fitted with the first elastic member, such that when the brushroll cover 20 needs to be closed, the brushroll cover 20 can push the first end of the snap 102 to retract into the communicating hole 105 and press the first elastic member, and then the first elastic member stores elastic potential energy; after the brushroll cover 20 is closed in place, the first snap groove 205 is just located at a position corresponding to the snap 102 and at the same time, the first elastic member releases the elastic potential energy to push the first end of the snap 102 to protrude out of the side wall of the first mounting groove 101 and be snapped into the first snap groove 205, so as to realize the firm fixation between the brushroll cover 20 and the ground brush body 10; and when the brushroll cover 20 needs to be opened, the release key 104 is pushed by hands to drive the snap 102 to leave the side wall of the first mounting groove 101, such that the first end of the snap 102 retracts into the communicating hole 105, at the same time, the snap 102 is separated from the snap connection with the first snap groove 205, and the force applied to the ground brush body 10 by the second end of the brushroll cover is removed, in which case the brushroll cover 20 can be rotated manually to be opened; or the brushroll cover 20 may rotate automatically to the open state under the torsion action of the torsional spring, at the same time, the first end of the snap 102 protrudes out from the side wall of the first mounting groove 101 again under the elastic action of the first elastic member, and the brushroll cover 20 can be opened and closed by such cycle, which is simple in structure, convenient in operation, easy and practicable.

The release key 104 and the snap 102 can be connected together, which facilitates the assembling of the release key 104 and the snap 102. Certainly, the release key 104 and the snap 102 may be configured as an integral structure which can be mounted in the ground brush body 10, during a process of assembling the ground brush body 10.

Figure 6:
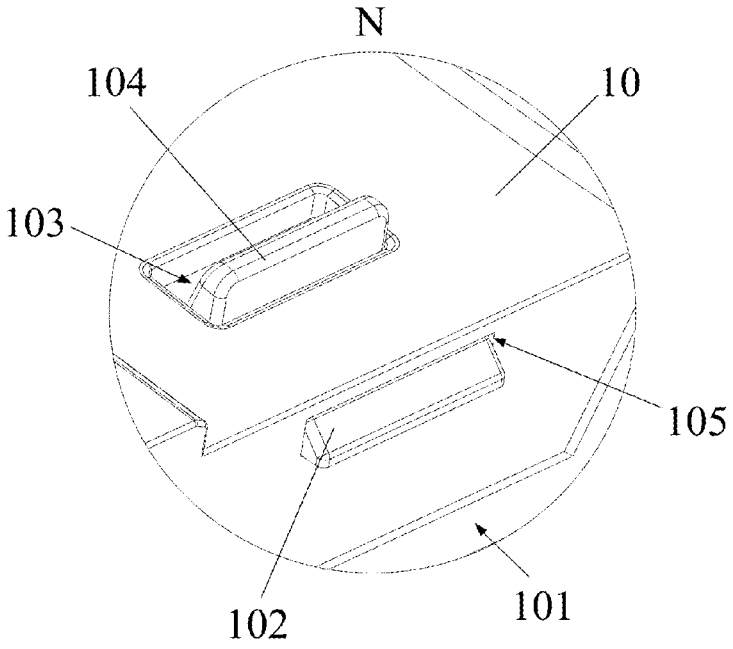
FIG. 6 is an enlarged view of part N in FIG. 5.

Preferably, as shown in FIG. 6, the first end of the snap 102 protruding out of the first mounting groove 101 has the triangular longitudinal section and the upper end face configured as a the guiding slope gradually inclining from the top down towards the inner side of the first mounting groove 101, such that the brush cover 20 can be smoothly closed on the ground brush body 10 along the guiding slope. The first end of the snap 102 has the lower end face configured as the plane parallel to the ground, such that the snap 102 can be prevented from falling out of the first snap groove 205 when the first end of the snap 102 is snapped into the first snap groove 205 in the brushroll cover 20, thus ensuring firmness when the brushroll cover 20 is closed on the ground brush body 10.

In another embodiment of the present disclosure, the outer side wall of the second end of the brushroll cover 20 is provided with the snap 102, the ground brush body 10 is provided with the snap groove cooperating with the snap 102, and the snap 102 can be snapped into the snap groove.

In the above embodiment of the present disclosure, the outer side wall of the second end of the brushroll cover 20 is provided with the snap 102, and the ground brush body 10 is provided with the snap groove correspondingly, so the second end of the brushroll cover 20 also can be fixedly or detachably connected with the ground brush body 10 through cooperation of the snap 102 and the snap groove, such that the brushroll cover 20 can be conveniently opened or closed, which will not be described in detail.

To sum up, in the ground brush according to the embodiments of the present disclosure, the ground brush body is provided with the first mounting groove, the first mounting groove has the upper opening and the lower opening in communication with each other, and the brushroll cover is provided with the second mounting groove; and the first mounting groove and the second mounting groove form the mounting space when the brushroll cover covers on the ground brush body, and the brushroll and the driving assembly 302 are mounted in the mounting space. The driving assembly 302 drives the brushroll to rotate, and the brushroll 3 can clean the carpet through the lower opening of the first mounting groove, thus accomplishing a normal cleaning function of the brushroll. As to a specific mounting position of the brushroll assembly 30, the brushroll assembly can be mounted in the first mounting groove, that is the brushroll assembly 30 is connected with the ground brush body, or the brushroll assembly can be mounted in the second mounting groove, that is the brushroll assembly is connected with the brushroll cover. When the brushroll needs to be cleaned or replaced, first the second end of the brushroll cover needs to be separated from the snap connection with the ground brush body 10, then the brushroll cover is rotated to be opened, the brushroll can be taken out from the first mounting groove or the second mounting groove, that is the brushroll can be taken out from the brushroll cover, i.e. the brushroll can be cleaned or replaced conveniently, which involves simple operations and is easy to use with less time and less effort. In such a way, the problem that the brushroll in the related art may be replaced only by turning over the ground brush, thereby resulting in tedious operation and inconvenient usage, can be solved to improve user experience.

Figure 7:
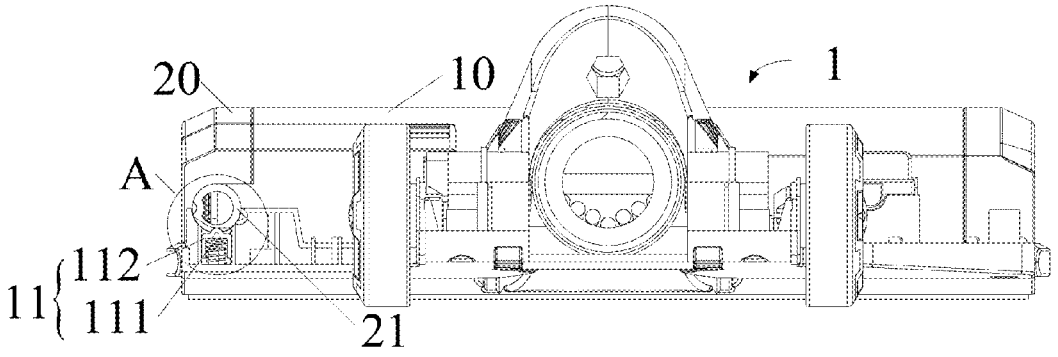
FIG. 7 is a schematic view of a ground brush for a vacuum cleaner according to an embodiment of the present disclosure, in which a brushroll cover is closed.
Figure 8:
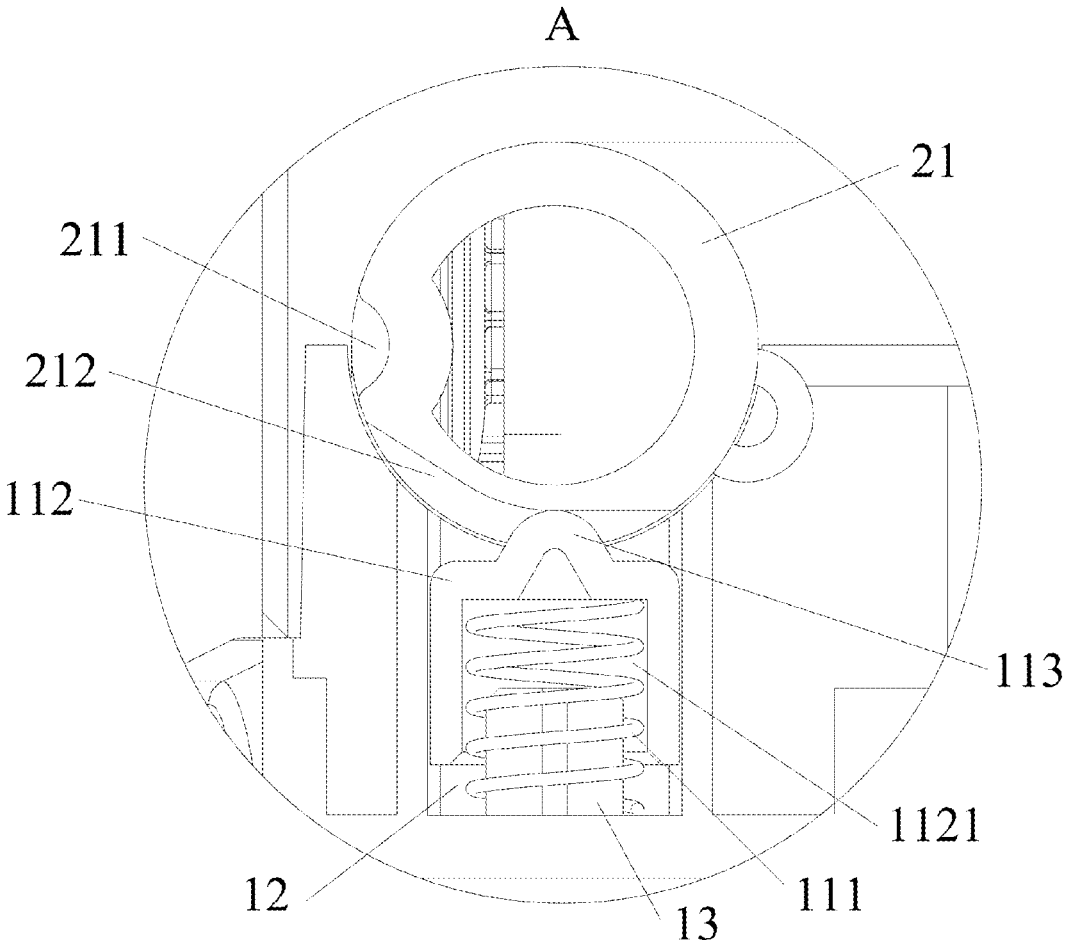
FIG. 8 is an enlarged view of part A circled in FIG. 7.
Figure 9:
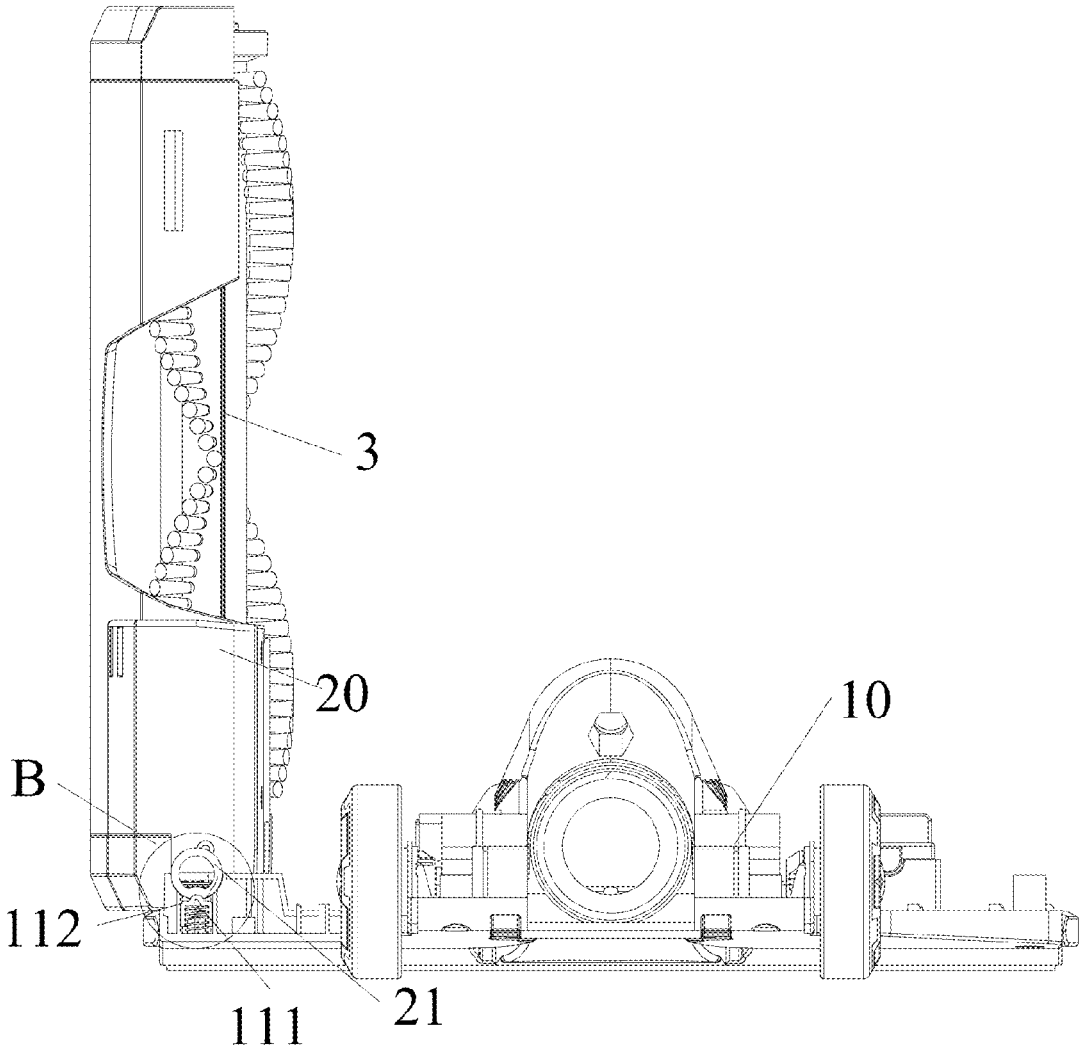
FIG. 9 is a schematic view of the ground brush shown in FIG. 7, in which the brushroll cover is locked.
Figure 10:
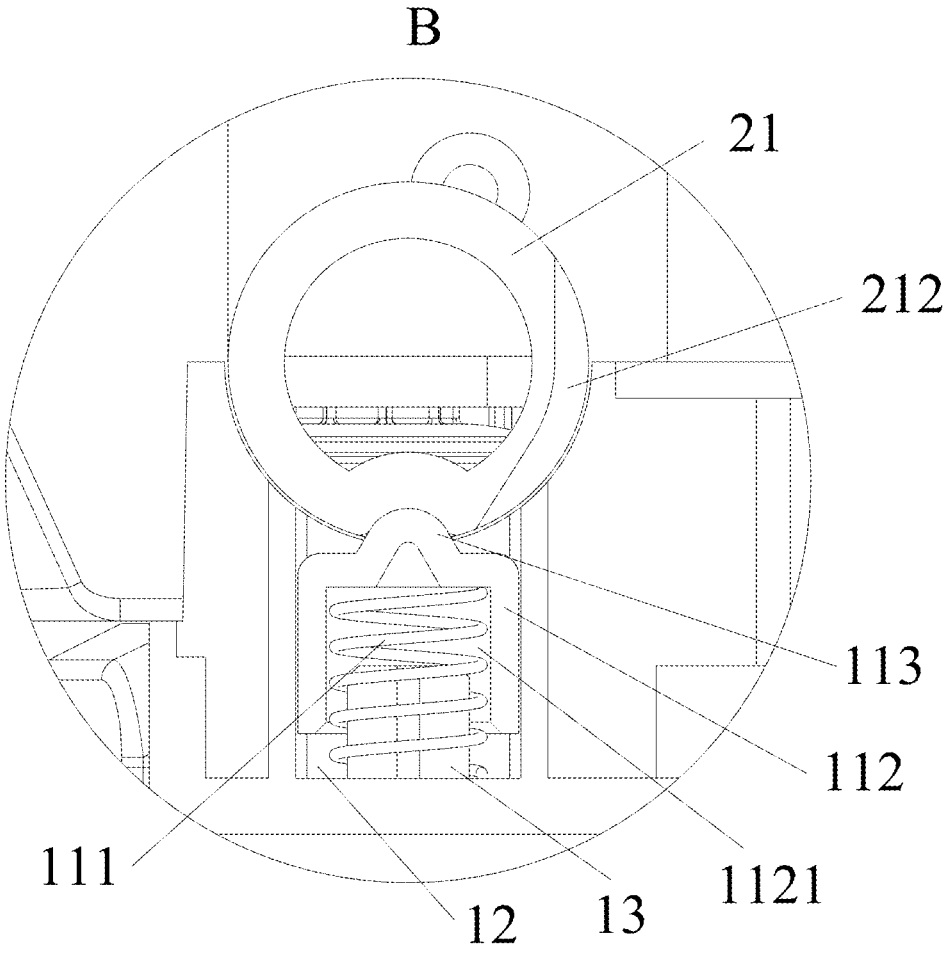
FIG. 10 is an enlarged view of part B circled in FIG. 9.

As shown in FIG. 7 to FIG. 16, the ground brush body 10 is provided with a first locking member, the first end of the brushroll cover 20 is rotatably connected to the ground brush body 10 through the rotating shaft 21. The rotating shaft 21 is provided with a second locking member, the first locking member cooperates with the second locking member when the brushroll cover 20 is rotatingly opened at a certain angle, such that the brushroll cover 20 is locked on the ground brush body 10. Accordingly, the rotating shaft 21 is fixed to the brushroll cover 20, such that the brushroll cover 20 can drive the rotating shaft 21 to rotate relative to the ground brush body 10. The rotating shaft 21 is provided with the second locking member cooperating with the first locking member, and as shown in FIG. 9 and FIG. 10, the first locking member cooperates with the second locking member when the brushroll cover 20 is rotatingly opened at a certain angle, such that the brushroll cover 20 is locked on the ground brush body 10, thus preventing the brushroll cover 20 from falling down. As shown in FIG. 7 and FIG. 8, when the brushroll cover 20 is opened at the certain angle and the brushroll cover 20 is closed on the ground brush body 10, the first locking member separates from the second locking member, and the brushroll cover 20 can rotate freely.

A locking position of the brushroll cover 20 (i.e. a rotating angle of the brushroll cover 20 when the brushroll cover 20 is locked) can de designed reasonably in actual use, and then a position of the first locking member and a position of the second locking member can be designed according to the locking position.

According to some embodiments of the present disclosure, one of the first locking member and the second locking member is configured as an elastic protruding structure 11, and the other one thereof is configured as a first locking groove 211. When the rotating shaft 21 is rotated to a position where the first locking groove 211 corresponds to the elastic protruding structure 11, the elastic protruding structure 11 is inserted into the first locking groove 211 to lock the brushroll cover 20 to the ground brush body 10.

Specifically, in a first embodiment, as shown in FIG. 8 and FIG. 10, the elastic protruding structure 11 (i.e. the first locking member) includes an elastic locking member 111 and a locking snapping member 112. The elastic locking member 111 has a lower end connected to the ground brush body 10, and an upper end face connected with the locking snapping member 112, such that the elastic locking member 111 can drive the locking snapping member 112 to reciprocate. The locking snapping member 112 has an upper end provided with a first protrusion 113. The second locking member is configured as a first locking groove 211 provided in the rotating shaft 21 and fitted with the first protrusion 113. When the rotating shaft 21 is rotated to a position where the first locking groove 211 corresponds to the first protrusion 113, the first protrusion 113 is inserted into the first locking groove 211 to lock the brushroll cover 20 to the ground brush body 10.

In the above embodiment, the lower end of the elastic locking member 111 is connected to the ground brush body 10, and the upper end of the elastic locking member 111 is connected with the locking snapping member 111, such that the elastic locking member 111 is supported between the ground brush body 10 and the locking snapping member 112, and the elastic locking member 111 can drive the locking snapping member 112 to reciprocate. Further, the locking snapping member 112 is provided with the first protrusion 113, and as shown in FIG. 3 and FIG. 4, when the brushroll cover 20 rotates at a certain angle, the first locking groove 211 in the rotating shaft 21 is rotated to the position corresponding to the first protrusion 113, such that the first protrusion 113 is inserted into the first locking groove 211, and the brushroll cover 20 is locked to the ground brush body, to prevent the brushroll cover 20 from falling down. When the brushroll cover 20 leaves the position at the certain angle, the first protrusion 113 separates from the first locking groove 211, to make the brushroll cover 20 rotate.

Preferably, as shown in FIG. 8 and FIG. 10, the locking snapping member 112 is provided with a third mounting groove 1121 with an open lower end. The upper end of the elastic locking member 111 is located in the third mounting groove 1121, such that the upper end of the elastic locking member 111 is stably fixed.

Further, as shown in FIG. 8 and FIG. 10, the ground brush body 10 is provided with a fourth mounting groove 12, a bottom wall of the fourth mounting groove 12 is provided with a mounting column 13 for the first protrusion 113. The lower end of the elastic locking member 111 is fitted over the mounting column 13, thus fixing the lower end of the elastic locking member 111 stably, and improving a reliability of the first locking member.

Furthermore, as shown in FIG. 8 and FIG. 10, the locking snapping member 112 has an external surface with a size matching a size of an inner wall face of the fourth mounting groove 12, such that the locking snapping member can reciprocate in the fourth mounting groove 12.

In the above embodiment, the size of the external surface of the locking snapping member 112 matches the size of the inner wall face of the fourth mounting groove 12, so the inner wall face of the fourth mounting groove 12 can guide a movement of the locking snapping member 112, and prevent the rotating shaft 21 from driving the first locking member to rotate, such that when the brushroll cover 20 rotate to the certain angle, the first locking member can cooperate with the second locking member, thus improving precision of the cooperation between the first locking member and the second locking member.

In one embodiment of the present disclosure, as shown in FIG. 8 and FIG. 10, the elastic locking member 111 is configured as a spiral spring.

In one embodiment of the present disclosure, as shown in FIG. 8 and FIG. 10, the rotating shaft 21 is provided with a clearance groove 212, and before the brushroll cover 20 is opened at the certain angle, the first protrusion 113 has an upper face abutted against a bottom wall of the clearance groove 212.

In the above embodiment, the rotating shaft 21 is provided with the clearance groove 212, and before the brushroll cover 20 is opened at the certain angle, the upper face of the first protrusion 113 abuts against the bottom wall of the clearance groove 212. When the brushroll cover 20 is rotated to be opened at the certain angle, the upper end face of the first protrusion 113 abuts against the bottom wall of the clearance groove 212 again. Because of a configuration of the clearance groove 212, the elastic locking member 111 can be prevented from being compressed excessively, the first protrusion 11 can be prevented from interfering with in an outer wall of the rotating shaft 21 during rotation of the rotating shaft 21, thus improving flexibility of the brushroll cover 20.

In a second embodiment, the first locking member is configured as a resilient sheet connected to the ground brush body 10, and an upper end face of the resilient sheet is provided with a second protrusion. The second locking member is provided in the rotating shaft 21 and configured as a second locking groove fitted with the second protrusion. When the rotating shaft 21 is rotated to a position where the second locking groove corresponds to the second protrusion, the second protrusion is inserted into the second locking groove to lock the brushroll cover 20 to the ground brush body 10.

In the above embodiment, the resilient sheet is provided with the second protrusion, and the brushroll cover 20 can still be locked through the fitting between the second protrusion and the second locking groove when it rotates to a certain angle, so as to prevent it from falling down.

In a third embodiment, the first locking member is configured as a third locking groove provided in the ground brush body 10, and the second locking member is configured as an elastic protrusion disposed on an outer surface of the rotating shaft. When the rotating shaft 21 is rotated to a position where a third locking groove corresponds to the elastic protrusion, the elastic protrusion is inserted into the third locking groove to lock the brushroll cover 2 to the ground brush body 1.

In the above embodiment, the rotating shaft 21 is provided with the elastic protrusion, and the ground brush body 10 is provided with the third locking groove. The brushroll cover 20 can also be prevented from falling down through the fitting between the elastic protrusion and the third locking groove. Certainly, if the ground brush body 10 is provided with the elastic protrusion, and the rotating shaft 21 is provided with the third locking groove, the brushroll cover 20 can also be prevented from falling down.

Preferably, a material of the elastic protrusion can be reasonably selected, so as to make the first locking member and the second locking member locked.

In some embodiments of the present disclosure, the brushroll cover 20 has a lower end rotatably connected with the ground brush body 10 via the rotating shaft, and an upper end provided with a snapping cooperating part; the brushroll 3 has an upper end provided with a snapping part. The snapping part is configured to cooperate with the snapping cooperating part, such that the brushroll cover 20 can drive the brushroll 3 to rotate relative to the ground brush body 10. Accordingly, a lower end of the brushroll 3 is connected with the lower end of the brushroll cover 20, and the upper end of the brushroll 3 is reliably connected with the upper end of the brushroll cover 2 through cooperation of the snapping part and the snapping cooperating part, such that the brushroll 3 can be reliably connected with the brushroll cover 20, the brushroll 3 can rotate along with the brushroll cover 20, and the upper end of the brushroll 3 can be prevented from falling out from the brushroll cover 20 during rotation. When the brushroll 3 needs to be mounted in or taken out from the brushroll cover 20, the snapping part can cooperate with the snapping cooperating part or be detached from the snapping cooperating part to realize connection or separation of the upper end of the brushroll 3 and the upper end of the brushroll cover 20, and then the lower end of the brushroll 3 can be connected with or taken out from the lower end of the brushroll cover 20, such that the brushroll 3 can rotate along with the brushroll cover and be prevented from falling out, and the brushroll 3 can mounted in and dismounted from the brushroll cover 20.

In the first embodiment of the present disclosure, the snapping part is configured as an elastic protrusion provided on an outer wall face of the brushroll 3, and the snapping cooperating part is configured as a second snap groove provided in an inner wall face of the brushroll 3.

Figure 11:
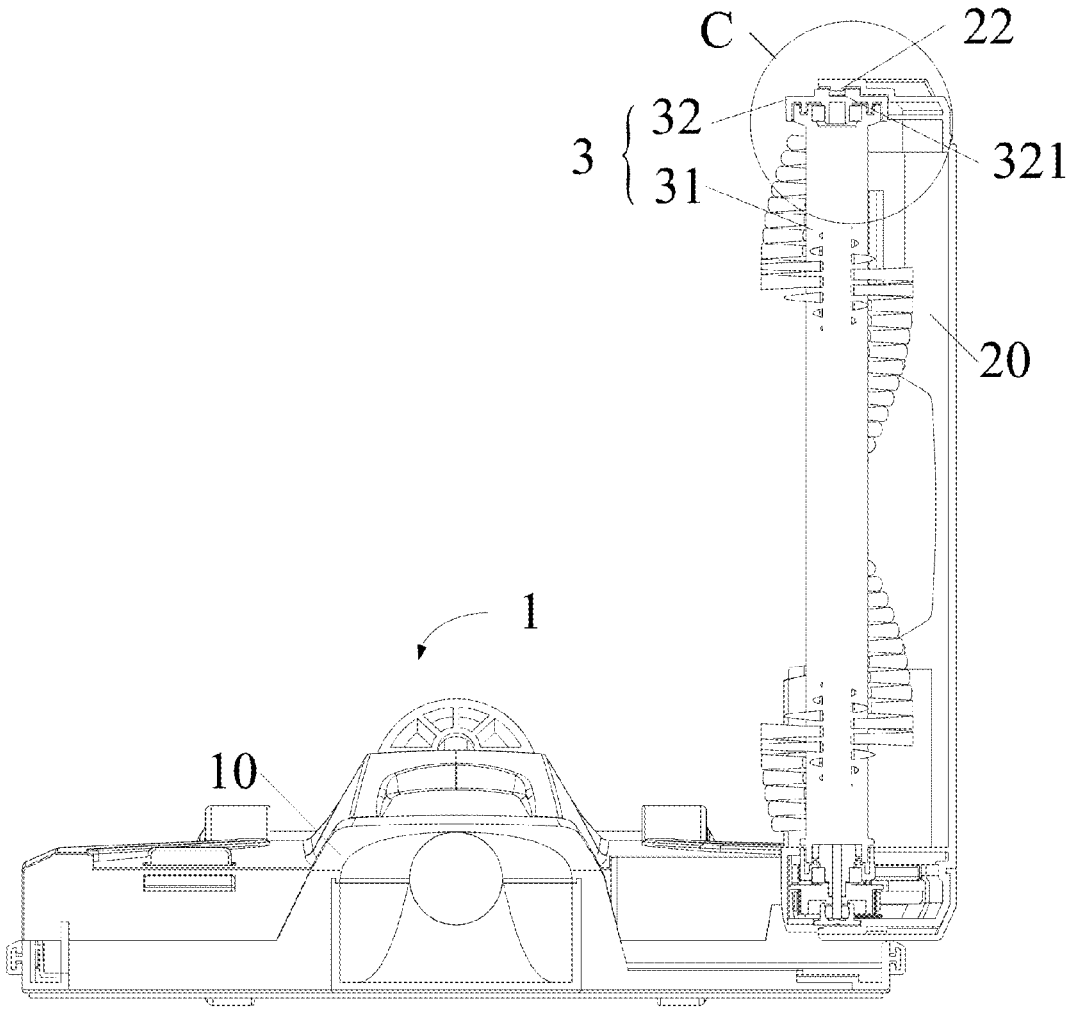
FIG. 11 is a schematic view of a ground brush for a vacuum cleaner according to an embodiment of the present disclosure.
Figure 12:
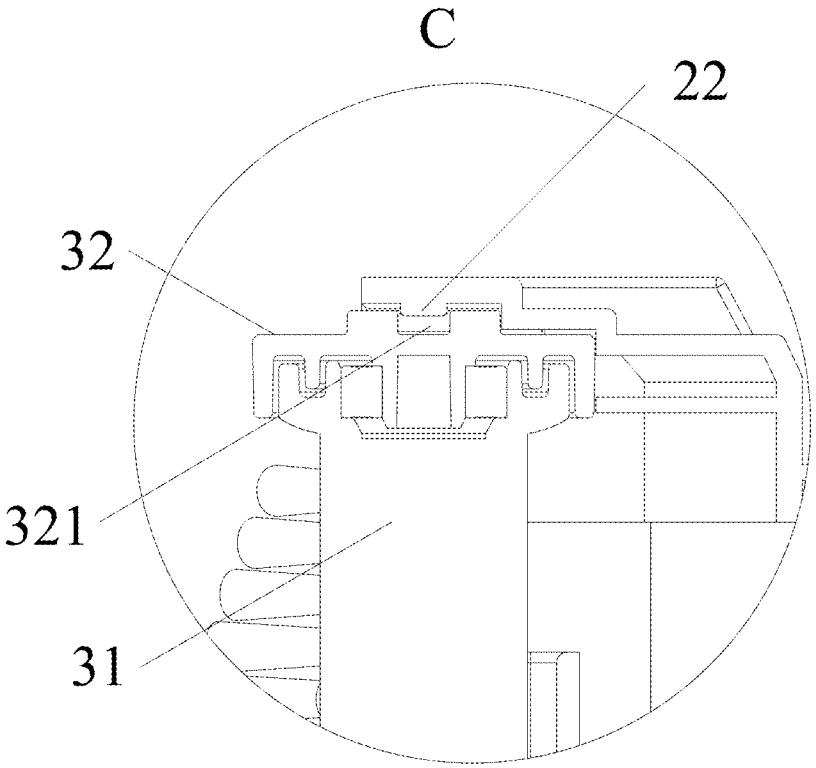
FIG. 12 is an enlarged view of part C circled in FIG. 11.

Certainly, the present disclosure is not limited thereby, in the second embodiment of the present disclosure, as shown in FIG. 11 and FIG. 12, the snapping part is configured as a third snap groove 321 provided in the outer wall face of the brushroll 3, and the snapping cooperating part is configured as the elastic protrusion 22 provided on the inner wall face of the brushroll cover 20.

In the above embodiment, the upper end of the brushroll 3 can be connected with the upper end of the brushroll cover 20 through cooperation of the elastic protrusion 22 and the third snap groove 321, to prevent the brushroll 3 from falling out during rotation. Moreover, the brushroll 3 can be conveniently mounted in or dismounted from the brushroll cover 20, through adjusting a force for fitting the elastic protrusion 22 into the third snap groove 321 or separating the elastic protrusion 22 from the third snap groove 321. The elastic protrusion 22 can be configured as an integral structure with the brushroll 3 or the brushroll cover 20, or the elastic protrusion 22 can be configured as a separate part made from a proper material and having a proper elasticity, and then be connected with the brushroll 3 or the brushroll cover 20, both of which fall into the scope of protection of the present disclosure.

In the third embodiment, the snapping part includes a second elastic member and a snapping member. The second elastic member has a lower end connected with the outer wall face of the brushroll 3, and an upper end connected with the snapping member, such that the second elastic member can drive the snapping member to reciprocate. The upper end of the snapping member is provided with a third protrusion, and the snapping cooperating part is configured as a fourth snap groove provided in the inner wall face of the brushroll cover 20 and fitted with the third protrusion.

In the above embodiment, the lower end of the second elastic member is connected with the outer wall face of the brushroll 3, and the upper end of the second elastic member is connected with the snapping member, such that the second elastic member is supported between the outer wall face of the brushroll 3 and the snapping member, and the second elastic member can drive the snapping member to reciprocate. Moreover, the snapping member is provided with the third protrusion, the upper end of the brushroll 3 can be connected with the upper end of the brushroll cover 20 by fitting the third protrusion in the fourth snap groove, to prevent the brushroll 3 from falling out of the brushroll cover 20. When the brushroll 3 needs to be dismounted, the third protrusion separates from the fourth snap groove through an elastic action of the second elastic member, to make the upper end of the brushroll 3 separate from the upper end of the brushroll cover 20. Similarly, when the brushroll 3 is mounted to the brushroll cover 20, the third protrusion can be snapped into the fourth snap groove through elastic deformation of the second elastic member, to make the upper end of the brushroll 3 connected with the upper end of the brushroll cover 20. Because of the second elastic member, a force for mounting and dismounting the brushroll 3 is proper, which is easy to operate.

Preferably, the outer wall face of the brushroll 3 is provided with a mounting groove, and the second elastic member is mounted in the mounting groove.

Preferably, the second elastic member is configured as a spiral spring.

Further, the fourth snap groove is configured as a through groove. The brushroll cover 20 also includes a key, and the key can be inserted in the through groove from top down. When the key is inserted in the through groove, the third protrusion separates from the through groove.

In the above embodiment, when the brushroll 3 needs to be taken out, the key is pressed down to be inserted in the through groove, so as to push the third protrusion out of the through groove. When the brushroll 3 is mounted, the key is pressed to move upwards to insert the third protrusion into the fourth snap groove, such that the brushroll 3 can be mounted on the brushroll cover 20. The brushroll 3 can be conveniently taken out and mounted by providing the key.

In a fourth embodiment of the present disclosure, the snapping cooperating part includes the second elastic member and the snapping member. The upper end of the second elastic member is connected to the inner wall face of the brushroll cover 20, and the snapping member is connected to the lower end of the second elastic member, such that the second elastic member can drive the snapping member to reciprocate. A lower end of the snapping member is provided with a fourth protrusion. The snapping part is the second groove fitted with the fourth protrusion provided in the outer wall face of the brushroll 3.

In the above embodiment, the snapping cooperating part includes the second elastic member and the snapping member on the brushroll cover 20, and the snapping part is configured as the fifth snap groove provided in the brushroll 3, which also can prevent the brushroll 3 from falling out during rotation of the brushroll cover 20, and mount and dismount the brushroll 3 to and from the brushroll cover 20.

In one specific embodiment of the present disclosure, as shown in FIG. 11, the brushroll 3 includes a brushroll body 31 and an end cap 32 covering on an upper end of the brushroll body 31, and the end cap is provided with the snapping part.

In an embodiment of the present disclosure, the ground brush 1 further includes a driving part for driving the brushroll 3, and the driving part is located on the lower end of the brushroll cover 20.

In the above embodiment, the driving part is configured to drive the brushroll 3 to rotate to make the vacuum cleaner work. Moreover, the driving part is connected with the lower end of the brushroll 3. Optionally, the lower end of the brushroll 3 can be inserted in a fixing groove, such that the lower end of the brushroll 3 can be connected with the lower end of the brushroll cover 20. When the brushroll 3 needs to be dismounted, the lower end of the brushroll 3 can be taken out from the fixing groove, to make the lower end of the brushroll 3 separate from the lower end of the brushroll cover 20.

As shown in FIG. 13 to FIG. 16, the brushroll cover 20 is provided with a triggering part 203, and the ground brush body 10 is provided with a microswitch 40. The triggering part 203 triggers the microswitch 40 to turn on a control circuit coupled with the brushroll when the brushroll cover 20 is closed on the ground brush body 10, and the triggering part 203 releases a trigger action on the microswitch 40 to turn off the control circuit when the brushroll cover 20 is opened.

Figure 13:
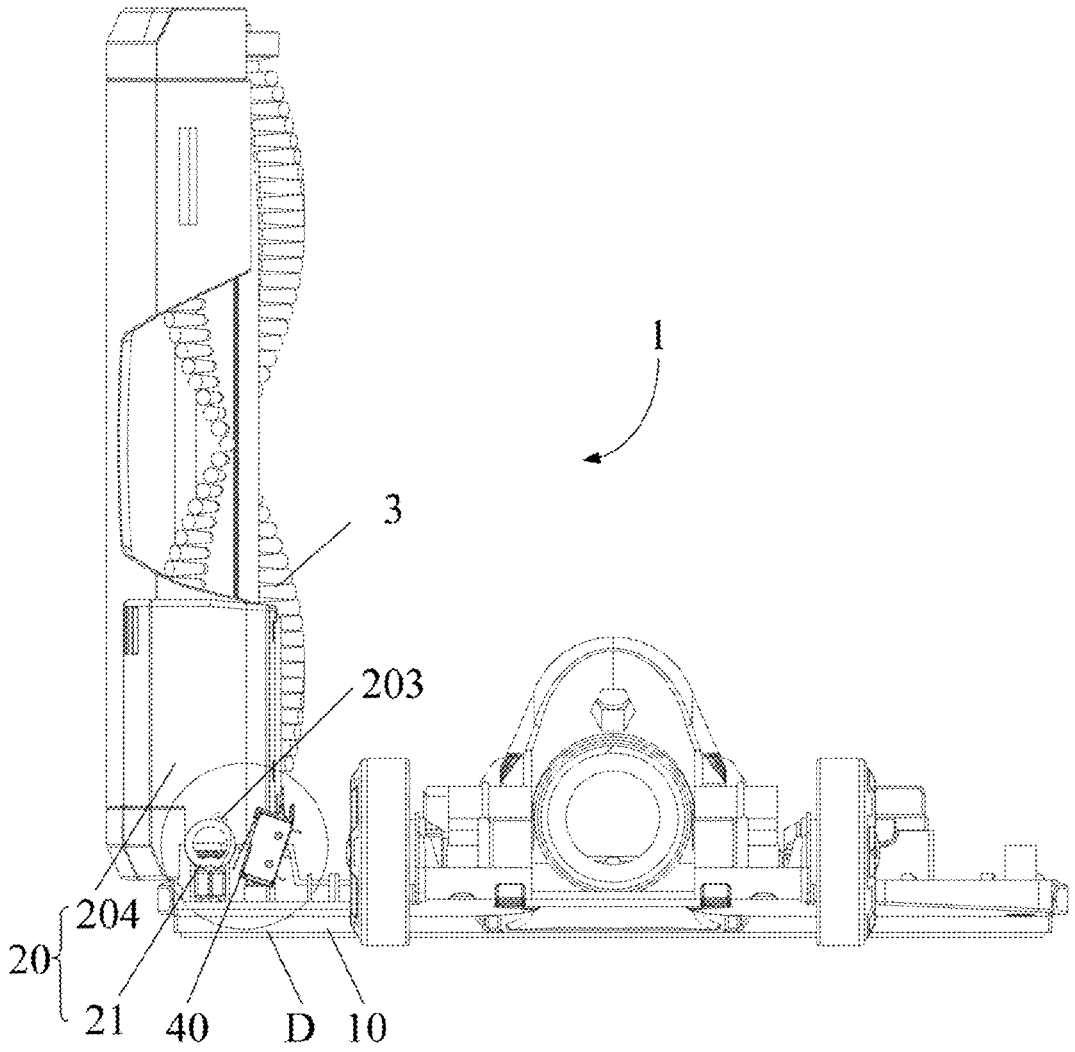
FIG. 13 is a schematic view of a ground brush for a vacuum cleaner according to an embodiment of the present disclosure, in which a brushroll cover is opened.
Figure 15:
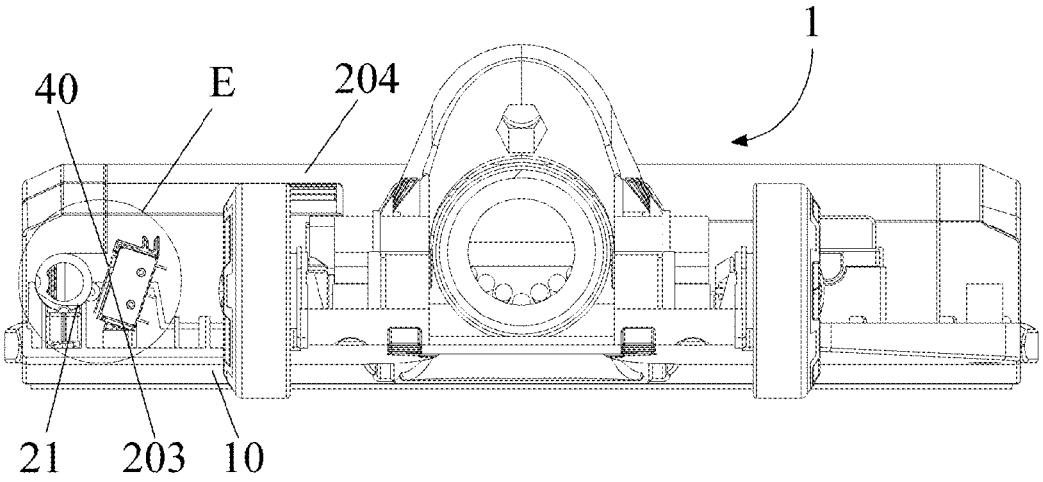
FIG. 15 is a schematic view of the ground brush shown FIG. 13, in which the brushroll cover is closed.

With reference to FIG. 13 and FIG. 15, the brushroll cover 20 is disposed on the ground brush body 10 in such a manner that the brushroll cover 20 can be opened and closed. The brushroll cover 20 and the ground brush body 10 define a mounting space therebetween, that is the brushroll cover 20 can be closed on the ground brush body 10 and can form the mounting space through cooperation with the ground brush body 10. The brushroll assembly is disposed in the mounting space and provided with a control circuit. The brushroll cover is provided with a triggering part 203 configured to cooperate with the microswitch 40.

The microswitch 40 is disposed on the ground brush body 10, electrically connected with the control circuit of the brushroll assembly, and configured to control the control circuit to be turned on or off. The microswitch 40 is disposed on the ground brush body 10, and the triggering part 203 triggers the microswitch 40 to turn on the control circuit when the brushroll cover 20 is closed on the ground brush body 10, and the triggering part 203 releases the microswitch 40 to turn off the control circuit when the brushroll cover 20 is opened.

Therefore, the triggering part 203 is disposed on the brushroll cover 20 and cooperates with the microswitch 40. When the brushroll cover 20 is closed, the triggering part 203 can trigger the microswitch 40 directly or indirectly to make the brushroll 3 work normally, and when the brushroll cover 20 is opened, the triggering part 203 can release the microswitch 40 to make the brushroll 3 stop working, thus avoiding accidental injury to a user caused by the brushroll 3 if the user opens the brushroll cover 20 by mistake, and improving safety and market competitiveness of a product.

Specifically, the overall brushroll cover 20 can be rotatably connected with the ground brush body 10 and closed or opened through turnover, or the brushroll cover 20 and the ground brush body 10 can be connected in a snapping manner or an inserting manner, that is the brushroll cover 20 can be closed or opened through mounting or dismounting, the overall brushroll cover 20 can be closed on the ground brush body 10, or separate from the ground brush body 10 to be opened.

In some embodiments of the present disclosure, as shown in FIG. 7 and FIG. 9, the brushroll cover 20 includes a cover body 204 and a connecting part. The cover body 204 cooperates with the ground brush body 10 to form the mounting space, and the connecting part is connected between the cover body 204 and the ground brush body 10 to make the cover body 204 connected to the ground brush body 10. The triggering part 203 is disposed on any one of the cover body 204 and the connecting part, that is the triggering part 203 may be disposed on the cover body 204 or disposed on the connecting part.

In the above embodiments, the brushroll cover 20 includes the cover body 204 and the connecting part, and the cover body 204 cooperates with the ground brush body 10 to form the mounting space to cover the brushroll 3, thus avoiding injury to the user when the brushroll 3 works, and improving safety of the ground brush 1. The brushroll assembly located in the mounting space may be mounted on the cover body 204 or mounted on the ground brush body 10, and preferably, the brushroll assembly is mounted on the ground brush body 10, which is simpler in structure and more convenient to assemble. The connecting part is connected with the cover body 204 and cooperates with the ground brush body 10, and the connecting part is configured to fix the cover body 204 to the ground brush body 10, thus preventing the brushroll cover 20 from separating from the ground brush body 10 and further improving the safety of the ground brush 1.

In some embodiments of the present disclosure, as shown in FIG. 7 to FIG. 16, the connecting part includes a rotating shaft 21, the cover body 204 is rotatingly closed on the ground brush body 10 through the rotating shaft 21, the triggering part 203 is disposed on the rotating shaft 21, and the rotating shaft 21 rotates to make the triggering part 203 trigger the microswitch 40 when the cover body 204 is rotatingly closed.

In the embodiments, as to a scheme that the brushroll cover 20 is closed on and connected with the ground brush body 10 in a rotating manner, when the brushroll cover 20 is closed on and connected with the ground brush body 10 through rotation of the rotating shaft 21, the triggering part 203 is disposed on the rotating shaft 21. In this way, when the cover body is rotated and to be closed, the triggering part 203 also rotates along with the rotating shaft 21 until that the cover body 204 is fully closed on the ground brush body 10, and the triggering part 203 also rotates exactly to a position corresponding to the microswitch 40 and triggers the microswitch 40, to turn on the control circuit of the brushroll assembly, thus guaranteeing that the vacuum cleaner can work normally. When the cover body 204 is rotated and to be opened, the triggering part 203 also rotates to separate from the microswitch 40, to turn off the control circuit of the brushroll assembly timely, and the brushroll 3 stops working immediately, thus avoiding accidental injury to the user caused by the brushroll 3 and improving the safety of the ground brush 1.

In some other embodiments of the present disclosure, the connecting part includes the rotating shaft 21, the cover body 204 is closed on the ground brush body 10 through rotating of the rotating shaft 21, the triggering part 203 is disposed on the cover body 204, and the triggering part 203 triggers the microswitch 40 when the cover body 204 is rotatingly closed.

In the embodiments, the connecting part includes the rotating shaft 21, that is the brushroll cover 20 is closed on and connected with the ground brush body 10 in a rotating manner; the triggering part 203 located at the cover body 204 will rotate along with the cover body 204 until the cover body 204 is fully closed on the ground brush body 10, and the triggering part 203 rotates exactly to a position corresponding to the microswitch 40 and triggers the microswitch, to turn on the control circuit of the brushroll assembly, thus guaranteeing that the vacuum cleaner can work normally. When the cover body 204 is rotated to be opened, the triggering part 203 also rotates to separate from the microswitch 40, to turn off the control circuit of the brushroll assembly timely, and the brushroll 3 stops working immediately, thus avoiding accidental injury to the user caused by the brushroll 3 and improving the safety of the ground brush 1.

In some more embodiments of the present disclosure, the connecting part includes at least one of a snapping member and an inserting member, through which the brushroll cover 20 is connected to the ground brush body 10, and the triggering part 203 is disposed on the cover body 204.

In the embodiments, the connecting part includes the snapping member and/or the inserting member, that is the brushroll cover 20 is closed on and connected with the ground brush body 10 through in a snapping manner or an inserting manner. Only when the cover body 204 is closed on the ground brush body 10, can the triggering part 203 located at the cover body 204 trigger the microswitch 40, to turn on the control circuit of the brushroll assembly, such that the vacuum cleaner can work normally. When the cover body 204 separates from the ground brush body 10, the triggering part 203 separates from the microswitch 40, too, such that the microswitch 40 returns, to turn off the control circuit of the brushroll assembly timely, and the brushroll 3 stops working immediately, thus avoiding accidental injury to the user caused by the brushroll 3 and improving the safety of the ground brush 1.

Figure 16:
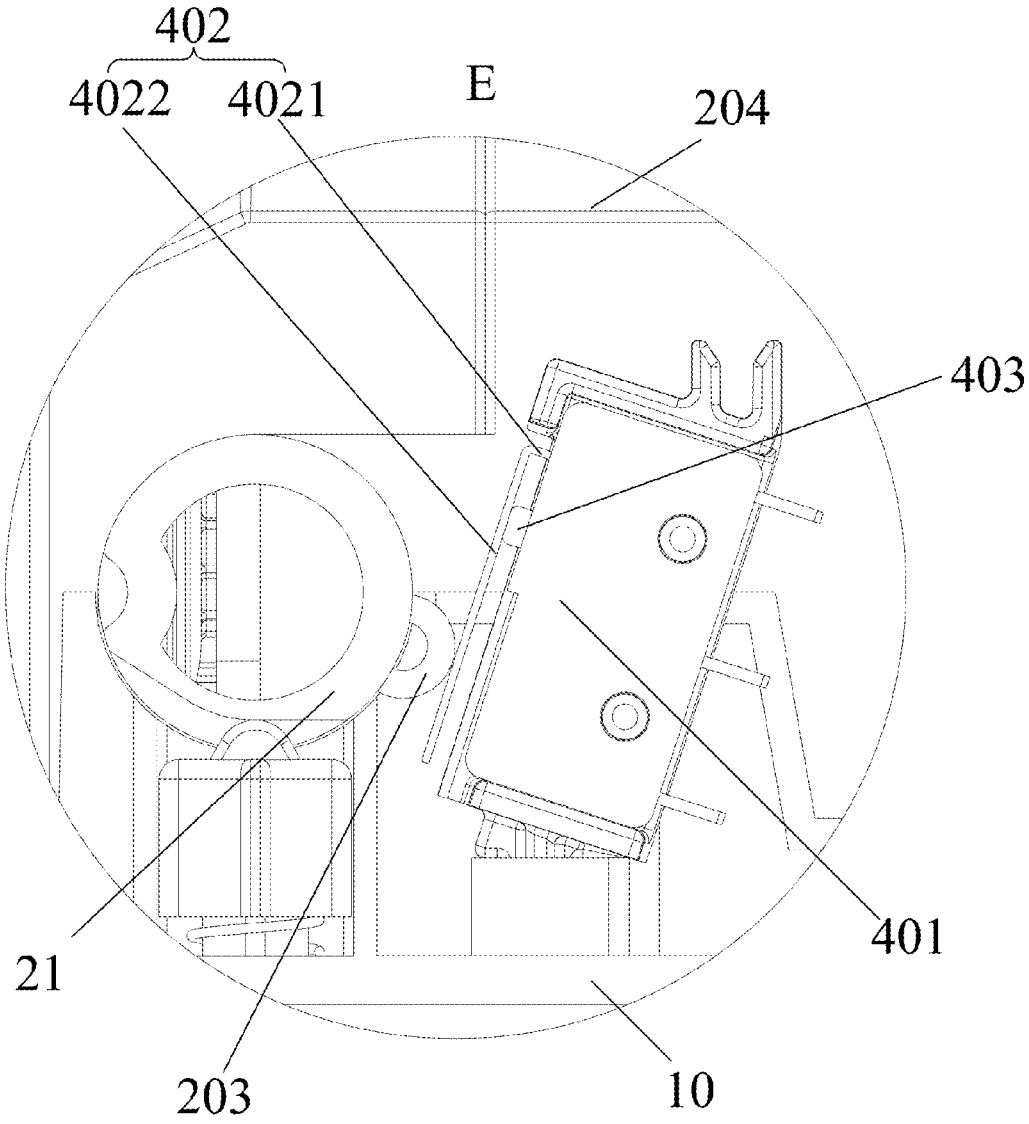
FIG. 16 is an enlarged view of part E circled in FIG. 15.

In some embodiments of the present disclosure, as shown in FIG. 15 and FIG. 16, when the brushroll cover 20 is closed on the ground brush body 10, the triggering part 203 directly contacts and triggers the microswitch 40.

Figure 14:
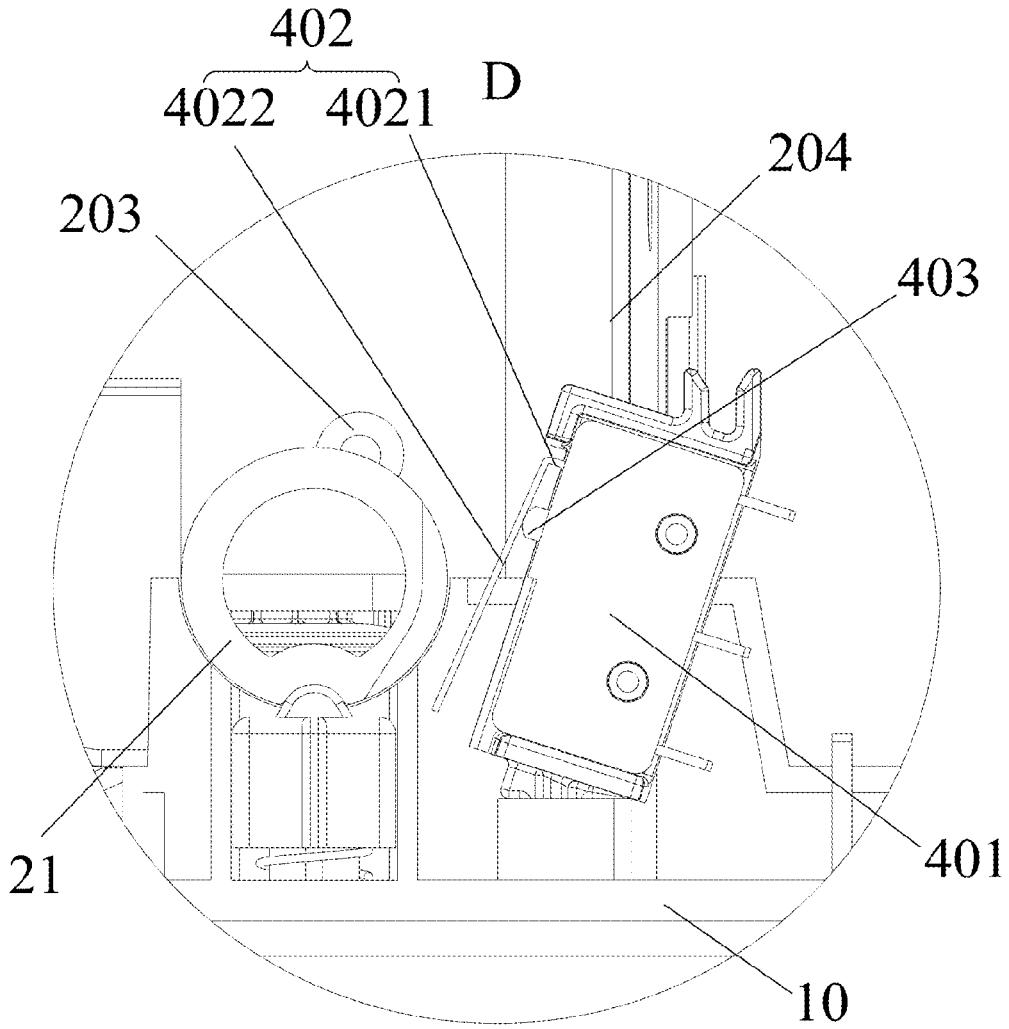
FIG. 14 is an enlarged view of part D circled in FIG. 13.

Further, as shown in FIG. 14 and FIG. 16, the microswitch 40 includes a fixing member 401, a resilient member 402 and a button 403. Specifically, the fixing member 401 is fixed to the ground brush body 10 and connected in the control circuit, the resilient member 402 is disposed on the fixing member 401, the button 403 is disposed on the fixing member 401, and the button 403 is located between the resilient member 402 and the fixing member 401. The triggering part 203 can turn on the control circuit through if the resilient member 402 presses the button 403, and when the triggering part 203 separates from the resilient member 402, the button 403 returns to turn off the control circuit.

Furthermore, the resilient member 402 may be rotatably disposed on the fixing member 401, when the brushroll cover 20 is closed, the triggering part 203 triggers the resilient member 402, such that the resilient member 402 rotates relative to the fixing member 401 and presses the button 403, to turn on the control circuit, and enables the brushroll assembly to work normally. When the brushroll cover 20 is opened, the triggering part 203 separates from the resilient member 402, the resilient member 402 returns to remove a pressure on the button 403, such that the button 403 returns automatically to turn off the control circuit, and the brushroll assembly stops working immediately, thus avoiding accidental injury to the user. Certainly, the present disclosure is not limited thereby, as shown in FIG. 14 and FIG. 16, the resilient member 402 may include a fixing part 4021 and a resilient part 4022. Specifically, the fixing part 4021 has a first end fixed to the fixing member 401, the resilient part 4022 has a first end connected with a second end of the fixing part 4021, and the resilient part 4022 has a second end extending to the button 403. Preferably, as shown in FIG. 14 and FIG. 16, the button 403 is close to a first end of the resilient part 4022.

Optionally, as shown in FIG. 14 and FIG. 16, the resilient member 402 is configured as an L-shaped resilient sheet.

In the above embodiments, the microswitch 40 includes the fixing member 401, the resilient member 402 and the button 403, and the fixing member 401 is coupled with the control circuit of the brushroll assembly. The button 403 can turn on or off the control circuit, the control circuit is turned off at a natural state; when the button 403 is pressed, the control circuit is turned on; and when the pressure is removed, the button returns automatically. The resilient member 402 is configured to press the button 403. Specifically, when the brushroll cover 20 is closed the triggering part 203 applies the pressure on the resilient member 402, and the resilient member 402 deforms resiliently to press the button 403, so as to turn on the control circuit, and enable the brushroll assembly to work normally. When the brushroll cover 20 is opened the triggering part 203 separates from the resilient member 402, the resilient member 402 returns to remove the pressure on the button 403, so the button 403 returns automatically to turn off the control circuit, and the brushroll assembly stops working, thus avoiding accidental injury to the user.

Certainly, those skilled in the art should understand that the microswitch 40 is not limited to the above structure, and it may be configured as a small button 403 or other structures, as long as having a function like that of the microswitch 40, so those technical schemes are within the scope of the present disclosure.

The resilient member 402 includes the fixing part 4021 and the resilient part 4022, the fixing part 4021 can fix the resilient member 402 to the fixing member 401, thus avoiding displacement of the resilient member 402 and guaranteeing usage reliability of the microswitch 40. The resilient part 4022 is resilient and can deform resiliently to apply a pressing force on the button 403, such that the button 403 can turn on the control circuit. A distance between the resilient member 4022 and a surface of the fixing part 402 is no less than a height of the button 403 at the natural state, thus guaranteeing that the button 403 is located between the resilient member 402 and the fixing member 401.

The button 403 is disposed closed to the first end of the resilient part 4022 connected with the fixing part 4021, and a second end of the resilient part 4022 is relatively far away from the button 403. As to the scheme that the brushroll cover 20 is rotatingly closed, only when the brushroll cover 20 is fully closed on the ground brush body 10, can the resilient part 4022 press the button 403 to a positon where the control circuit is turned on. In the process of rotatingly closing the brushroll cover 20, the button 403 cannot turn on the control circuit, thus avoiding that the brushroll starts working when the brushroll cover 20 is not fully closed, and further improving the safety of the product.

In other embodiments of the present disclosure, the ground brush 1 further includes a driving member which is disposed on the ground brush body 10 and cooperates with the microswitch 40. When the brushroll cover 20 is closed on the ground brush body 10, the triggering part 203 triggers the driving member and contacts the microswitch 40 indirectly through the driving member.

In the above embodiments, the triggering part 203 triggers the microswitch 40 through the driving member, that is when the brushroll cover 20 is closed on the ground brush body 10, the microswitch 40 is not directly but indirectly triggered, which can also accomplish the objective of the present disclosure. Specifically, when the brushroll cover 20 is closed, the triggering part 203 triggers the driving member to apply an acting force on the driving member, such that the driving member moves to trigger the microswitch 40, so as to turn on the control circuit. When the brushroll cover 20 is opened, the triggering part 203 separates from the driving member, the acting force applied on the driving member is removed, so an acting force on the microswitch 40 applied by the driving member is removed, the microswitch 40 returns to turn off the control circuit.

A vacuum cleaner according to an embodiment of a second aspect of the present disclosure includes the ground brush 1 according to the embodiments of the first aspect of the present disclosure.

In the vacuum cleaner according to the embodiment of the present disclosure, when the brushroll cover 20 is rotated at a certain angle, the first locking member cooperates with the second locking member, to make the brushroll cover 20 lock to the ground brush body 10, so as to prevent the brushroll cover 20 from falling down. When the brushroll cover 20 is opened at the certain angle, that is the brushroll cover 20 is closed on the ground brush body 10, the first locking member separates from the second locking member, and the brushroll cover 20 can rotate freely.

To sum up, in the ground brush 1 provided by the embodiments of the present disclosure, the lower end of the brushroll 3 is connected with the lower end of the brushroll cover 20, and the upper end of the brushroll 3 can be reliably connected with the upper end of the brushroll cover 20 through cooperation of the snapping part and the snapping cooperating part, such that the brushroll 3 is reliably connected with the brushroll cover 20, and the brushroll 3 can rotate along with the brushroll cover 20, thus preventing the upper end of the brushroll 3 from falling out of the brushroll cover 20 during rotation. The brushroll 3 can be mounted in or dismounted from the brushroll cover 20 through cooperation or separation of the snapping part and the snapping cooperating part.

As the triggering part 203 and the microswitch 40 are provided, when the brushroll cover 20 is closed, the triggering part 203 may trigger the microswitch 40 directly or indirectly, to turn on the control circuit of the brushroll assembly, and a driving part drives the brushroll 3 to rotate, such that the vacuum cleaner works normally. When the brushroll cover 20 is opened, the triggering part 203 can release a trigger action thereof, the microswitch 40 returns to turn off the control circuit of the brushroll assembly, the driving part stops working, to make the brushroll 3 stop rotating, thus avoiding injury to the user.

It is should be noted that those skilled in the art should understand that the triggering part 203 may be configured as a component individually disposed on the brushroll cover 20 or a part of the brushroll cover 20, both of which can accomplish the function of the microswitch 40 both, and fall into the scope of the present disclosure.

As the vacuum cleaner is provided with the ground brush 1 according the embodiments of the first aspect, the vacuum cleaner has high safety and will not injure the user if the user opens the brushroll cover 20 by mistake.

To sum up, in the ground brush 1 provided by the present disclosure, the brushroll cover 20 is provided with the triggering part 203, and the triggering part 203 cooperates with the microswitch 40. When the brushroll cover 20 is closed, the triggering part 203 can trigger the microswitch 40 directly or indirectly to make the brushroll 3 work normally, and when the brushroll cover 20 is opened, the triggering part 203 can release a trigger action on the microswitch 40 to make the brushroll stop working, thus avoiding accidental injury to the user if the user opens the brushroll cover 20 by mistake, and improving safety and market competitiveness of the product.

Specifically, as to a present vacuum cleaner, a brushroll is still working when a brushroll cover is opened, which may injure the user accidentally. However, as to the ground brush 1 provided by the present disclosure, the brushroll stops working when the brushroll cover 20 is opened, thus avoiding injury to the user, and improving the safety and the market competitiveness of the product. Specifically, when the brushroll cover 20 is closed, the triggering part 203 can trigger the microswitch 40 directly or indirectly to turn on the control circuit of the brushroll assembly, and the driving part drives the brushroll 3 to rotate, such that the vacuum cleaner works normally; when the brushroll cover 20 is opened, the triggering part 203 can release the trigger action thereof, the microswitch 40 returns to turn off the control circuit of the brushroll assembly, and the driving part stops working to make the brushroll stop rotating, thus avoiding injury to the user.

Reference throughout this specification to "an embodiment," "some embodiments," "an example," "specific examples" or "some examples" means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples and the features in different embodiments or examples in the specification.

Although embodiments of the present invention have been shown and illustrated, it shall be understood by those skilled in the art that various changes, modifications, alternatives and variants without departing from the principle and spirit of the present invention are acceptable. The scope of the present invention is defined by the claims or the like.

What is claimed is:

1. A ground brush for a vacuum cleaner, comprising:

a ground brush body provided with a first mounting groove, wherein the first mounting groove has an upper opening and a lower opening in communication with each other;

a brushroll cover covering on the ground brush body, having a first end rotatably connected with the ground brush body and a second end snapped into the ground brush body, and having a second mounting groove, wherein the first mounting groove and the second mounting groove cooperate to form a mounting space, wherein the first end of the brushroll cover is rotatably connected with the ground brush body through a rotating shaft, the rotating shaft is provided with a torsional spring, and the torsional spring is configured to make the second end of the brushroll cover normally rotate towards a direction away from the ground brush body; and a brushroll assembly comprising a brushroll and a driving assembly, wherein the brushroll is mounted in the mounting space.

2. The ground brush according to claim 1, wherein the second end of the brushroll cover has an outer side wall provided with at least one first snap groove, the ground brush body is provided with at least one snap cooperating with the at least one snap groove, and the at least one snap has a first end protruding a side wall of the first mounting groove and snapped into the at least one first snap groove;

the ground brush body has an upper end face provided with a mounting hole, in which a release key is mounted, the mounting hole has a first side wall provided with a communicating hole running through the side wall of the first mounting groove, the at least one snap has a second end connected with a lower end of the release key, and the release key can be pushed to drive the at least one snap to move in the communicating hole to approach or leave the side wall of the first mounting groove;

a first elastic member is supported between a second side wall of the mounting hole opposite the communicating hole and the release key, and the first elastic member can push the release key to approach the side wall of the first mounting groove, such that the first end of the snap protrudes out of the side wall of the first mounting groove.

3. The ground brush according to claim 1, wherein the brushroll is disposed to the brushroll cover or the ground brush body.

4. The ground brush according to claim 1, wherein the ground brush body is provided with a first locking member, the rotating shaft is provided with a second locking member, and when the brushroll cover is rotated to be opened at a certain angle, the first locking member cooperates with the second locking member to lock the brushroll cover to the ground brush body.

5. The ground brush according to claim 4, wherein one of the first locking member and the second locking member is configured as an elastic protruding structure, and the other one thereof is configured as a first locking groove, when the rotating shaft is rotated to a position where the first locking groove corresponds to the elastic protruding structure, the elastic protruding structure is inserted into the first locking groove to lock the brushroll cover to the ground brush body.

6. The ground brush according to claim 5, wherein the elastic protruding structure comprises an elastic locking member and a locking snapping member, the elastic locking member has a lower end connected to the ground brush body and an upper end connected with the locking snapping member, such that the elastic locking member can drive the locking snapping member to reciprocate, and the locking snapping member has an upper end face provided with a first protrusion; and the first locking groove is formed in the rotating shaft and fitted with the first protrusion, when the rotating shaft is rotated to a position where the first locking groove corresponds to the first protrusion, the first protrusion is inserted into the first locking groove to lock the brushroll cover to the ground brush body.

7. The ground brush according to claim 6, wherein the locking snapping member is provided with a third mounting groove with an open lower end, and the upper end of the elastic locking member is located in the third mounting groove;

the ground brush body is provided with a fourth mounting groove, a bottom wall of the fourth mounting groove is provided with a mounting column protruding upwards, and the lower end of the elastic locking member is fitted over the mounting column.

8. The ground brush according to claim 6, wherein the rotating shaft is provided with a clearance groove, and before the brushroll cover is opened at the certain angle, an upper end face of the first protrusion abuts against a bottom wall of the clearance groove.

9. The ground brush according to claim 1, wherein a lower end of the brushroll cover is connected with the ground brush body through the rotating shaft, an upper end of the brushroll cover is provided with a snapping cooperating part, an upper end of the brushroll is provided with a snapping part, and the snapping part is configured to cooperate with the snapping cooperating part, such that the brushroll cover can drive the brushroll to rotate relative to the ground brush body.

10. The ground brush according to claim 9, wherein the snapping part is configured as an elastic protrusion provided on an outer wall face of the brushroll, and the snapping cooperating part is configured as a second snap groove provided in an inner wall face of the brushroll cover; or the snapping part is configured as a third snap groove provided in the outer wall face of the brushroll, and the snapping cooperating part is configured as an elastic protrusion provided on the inner wall face of the brushroll cover.

11. The ground brush according to claim 9, wherein the snapping part comprises a second elastic member and a snapping member, the second elastic member has a lower end connected with an outer wall face of the brushroll and an upper end connected with the snapping member, such that the second elastic member can drive the snapping member to reciprocate, and an upper end face of the snapping member is provided with a third protrusion; and the snapping cooperating part is configures as a fourth snap groove provided in an inner wall face of the brushroll cover and fitted the third protrusion.

12. The ground brush according to claim 11, wherein the fourth snap groove is configured as a through groove, the brushroll cover further comprises a key which can be inserted into the through groove from top down, and when the key is inserted in the through groove, the third protrusion separates from the through groove.

13. The ground brush according to claim 9, wherein the snapping cooperating part comprises a second elastic member and a snapping member, the second elastic member has an upper end connected to an inner wall face of the brushroll cover and a lower end connected to the snapping member, such that the second elastic member can drive the snapping member to reciprocate, and a lower end face of the snapping member is provided with a fourth protrusion; and the snapping part is a fifth snap groove provided in an outer wall face of the brushroll and fitted with the fourth protrusion.

14. The ground brush according to claim 1, wherein the brushroll cover is provided with a triggering part, and the ground brush body is provided with a microswitch; and the triggering part triggers the microswitch to turn on a control circuit connected with the brushroll when the brushroll cover is closed on the ground brush body, and the triggering part releases a trigger action on the microswitch to turn off the control circuit when the brushroll cover is opened.

15. The ground brush according to claim 14, wherein the brushroll cover comprises:

a cover body cooperating with the ground brush body to form a mounting space; and a connecting part connected between the cover body and the ground brush body to make the cover body connected to the ground brush body, wherein the triggering part is disposed on any one of the cover body and the connecting part.

16. The ground brush according to claim 15, wherein the connecting part comprises the rotating shaft, the cover body is rotatingly closed on the ground brush body through the rotating shaft, wherein the triggering part is disposed on the rotating shaft, and the rotating shaft rotates to make the triggering part trigger the microswitch when the cover body is closed.

17. The ground brush according to claim 15, wherein the connecting part comprises the rotating shaft, the cover body is rotatingly closed on the ground brush body through the rotating shaft, wherein the triggering part is disposed on the brushroll cover, and the triggering part triggers the microswitch when the brushroll cover is closed.

18. The ground brush according to claim 14, wherein when the brushroll cover is closed on the ground brush body, the triggering part directly contacts and triggers the micro switch.

19. The ground brush according to claim 14, wherein the microswitch comprises:

a fixing member fixed to the ground brush body and coupled with the control circuit;

a resilient member disposed on the fixing member; and a button disposed on the fixing member and located between the resilient member and the fixing member, wherein the triggering part can turn on the control circuit if the resilient member presses the button, and when the triggering part separates from the resilient member, the button returns to turn off the control circuit.

20. The ground brush according to claim 14, further comprising:

a driving member disposed on the ground brush body and cooperating with the microswitch, wherein when the brushroll cover is closed on the ground brush body, the triggering part triggers the driving member and then triggers the microswitch indirectly through the driving member.

21. A vacuum cleaner comprising a ground brush according to claim 1.

* * * * *